US005826485A

United States Patent [19]

Bayne et al.

[11] Patent Number: 5,826,485

[45] Date of Patent: Oct. 27, 1998

[54] RESIDENTIAL REFUSE COLLECTION CART LIFTER WITH UNIVERSAL FEATURE

[75] Inventors: Jimmy O. Bayne; Michael J. Susil, both of Simpsonville, S.C.

[73] Assignee: Bayne Machine Works, Inc., Simpsonville, S.C.

[21] Appl. No.: 735,614

[22] Filed: Oct. 23, 1996

Related U.S. Application Data

[62] Division of Ser. No. 459,749, Jun. 2, 1995, which is a division of Ser. No. 267,777, Jun. 28, 1994, Pat. No. 5,447,405, which is a division of Ser. No. 979,153, Nov. 23, 1992, Pat. No. 5,333,984, which is a continuation-in-part of Ser. No. 903,078, Jun. 22, 1992, Pat. No. 5,308,211.

[51] Int. Cl.[6] ..... B65F 3/02; F15B 15/22

[52] U.S. Cl. ..... 91/405; 92/85 B; 414/408; 414/421

[58] Field of Search ..... 91/404, 405, 406, 91/407, 408, 409, 468; 92/85 B; 414/408, 421, 420, 406, 404, 419, 546, 303, 409

[56] References Cited

U.S. PATENT DOCUMENTS

| | | | |
|---|---|---|---|
| 3,162,092 | 12/1964 | Corwin | 91/407 X |
| 4,255,930 | 3/1981 | Natalie | 92/85 B X |
| 4,397,218 | 8/1983 | Spring | 91/406 X |
| 4,479,751 | 10/1984 | Wyman et al. | 414/406 |
| 4,773,812 | 9/1988 | Bayne et al. | 414/408 |
| 5,163,805 | 11/1992 | Mezey | 414/406 X |
| 5,308,211 | 5/1994 | Bayne et al. | 414/408 |
| 5,333,984 | 8/1994 | Bayne et al. | 414/408 |
| 5,447,405 | 9/1995 | Bayne et al. | 414/408 |

*Primary Examiner*—Hoang Nguyen
*Attorney, Agent, or Firm*—Dority & Manning, PA

[57] ABSTRACT

A lifter automatically adapts to pick up different style residential refuse collection carts. An upper movable clamp bar cooperates with a finger support bar to grab a smooth-sided cart with a single upper lifting lip. A hinged saddle and hinged sliding hook lifts carts having a pair of opposing engagement surfaces (e.g., bars). Hinged members are automatically pivoted into retracted positions during presentation of smooth sided carts, but are otherwise maintained in place for engaging other type carts. The lifter has a relatively short face plate for size and weight advantages, obtained by alternate extension/retraction of the hinged sliding hook during a lift cycle. Rollers on the extending face plate prevent cart scarring. Adjustment for different height carts is provided by a vertical lift assembly which uses a hydraulic sequencing valve to first raise the lifter for engaging the cart and then to cycle through a dumping process. Vertical lift adjustment uses a pair of guide rods with pairs of slip fit bushings for improved dynamic operational stability. A movable valving member is engaged by a piston for automatically reducing the flow rate of hydraulic oil as the piston nears the end of its cycle, i.e., as a cart is being fully inverted and dumped. Such action dampens cart and apparatus wear and strain. The piston responsive variable valving features are also useful with devices other than cart lifters.

27 Claims, 17 Drawing Sheets

RESIDENTIAL REFUSE COLLECTION CART LIFTER WITH UNIVERSAL FEATURE

This is a division of application Ser. No. 08/459,749 filed Jun. 2, 1995, which is a division of U.S. Ser. No. 08/267,777 filed Jun. 28, 1994 now U.S. Pat. No. 5,447,405, which is a division of U.S. Ser. No. 07/979,153, filed Nov. 23, 1992, now U.S. Pat. No. 5,333,984, which is a continuation-in-part of U.S. Ser. No. 07/903,078, filed Jun. 22, 1992, now U.S. Pat. No. 5,308,211.

BACKGROUND OF THE INVENTION

The present application is a continuation-in-part of applicant's prior application U.S. Ser. No. 07/903,078, accorded a filing date of Jun. 22, 1992.

The present invention concerns in general improved receptacle dumping apparatus and in particular concerns lifter technology with universally adaptive features for use with residential refuse collection carts of different types, and other lifter and nonlifter improvements.

Technology related to residential refuse collection (and other service areas) has advanced in the last several decades generally from the use of metal trash cans which were manually lifted and dumped to the use of receptacles with wheels which are rolled by the resident down a driveway or the like to a curb location at which the receptacle is lifted and dumped by a particular lifting apparatus. One example of such a lifting apparatus for lifting and dumping rollable receptacles is disclosed in Bayne et al. (U.S. Pat. No. 4,773,812) issued Sep. 27, 1988, and Reexamination Certificate issued on Apr. 16, 1991.

As the number of designers competing in the newer technology rolling carts and cart lifters increased, different styles of carts emerged together with specialized lifters for handling a specific cart type.

One cart type which became prominent includes two opposing engagement members located respectively near the top and middle of the cart and which are grasped for lifting and dumping of the cart. Operation of a lifting element below the upper cart engagement member permits the cart to be lifted while operation of another engaging element in the opposite direction and directed at the lower cart engagement member permits the cart to be retained on a carriage as the cart is raised and inverted during dumping. Such cart style is in the industry sometimes referred to as a bar lift cart or U.S. or "Domestic" style cart.

The following patents all provide examples of such domestic cart style and typically hydraulically actuated lifting devices for raising and inverting such carts for dumping the contents thereof into a further receptacle such as a refuse collection vehicle or a relatively larger collection box. See for example the cart 10 of FIG. 7 of Shive (U.S. Pat. No. 3,894,642), as well as the carts and corresponding lifters therefor as utilized in Borders (U.S. Pat. Nos. 4,422,814 and 4,365,922), and Brown et al. (U.S. Pat. No. 3,804,277). In general, such patents disclose various mechanisms for controllably manipulating a lower engagement member of the lifter in a generally downward direction for engaging the relative top side of a lower engagement bar of the cart to be emptied. Each of the patents are commonly assigned to Rubbermaid Corporation of Statesville, N.C., or its successor Applied Products, Inc., of Statesville, N.C., now Toter, Inc., of Statesville, N.C., a manufacturer or distributor of roll-out carts and cart lifters.

An alternate version of the "Domestic" style cart is represented by refuse container 12 of FIG. 1 of Wyman et al.

(U.S. Pat. No. 4,479,751). In such patent, the receptacle itself has two separate bars which are again engaged by respective upper and lower lifter engagement members. The lower lifter engagement member is again pivoted in a relatively downward direction for engaging the relatively upper most surface of the lower cart bar. A second bar is substituted in the upper position in place of the molded engagement region or moldably encased bar of the above-referenced Toter, Inc., patent designs.

Other examples of lifter mechanisms designed for use with specific (and rollable) refuse containers are disclosed by Jones (U.S. Pat. No. 3,931,901) and Wells (U.S. Pat. No. 3,738,516).

Another style of roll-out cart which has become relatively prominent is known as a "European" style cart. Such a cart has generally smooth sides (i.e., does not have external bars or their equivalents along a side thereof, but has instead a molded upper lip which is adequately reinforced and sized for being adequately clamped for lifting and dumping of the "European" style cart by engagement at such single engagement member or point. An example of such a "European" style cart is represented by cart 50 of FIG. 3 of Naab (U.S. Pat. No. 4,613,271).

Generally speaking, the same lifter mechanism features (i.e., engagement members) cannot be used for engaging and lifting different cart styles, particularly as between the above-described "Domestic" and "European" cart styles and related variations. Therefore, most cart lifters have heretofore been of a dedicated design, that is, structured for use with either the European style cart or the domestic style cart, but not both. At the same time, the increase of companies competing for residential trash pickup in a single neighborhood, and due to other factors, has resulted in mixed varieties or styles of carts on a single trash pickup route. Such situation necessitates that the refuse collection vehicle be somehow equipped for handling (i.e., lifting and dumping) the different cart styles which will likely be encounted during a typical trash collection run.

While refuse collection vehicle styles have varied in recent years, just as has the technology described above (such as rear load, side load, and front load vehicles), only several lifter units can be ordinarily outfitted onto a refuse collection vehicle at a given time. Therefore, an entire truck or refuse collection vehicle becomes in a sense dedicated to a particular cart style just as does the design of the lifter. Since refuse collection vehicles can cost as much as One Hundred Fifty Thousand Dollars ($150,000), requiring duplication of vehicles simply in order to handle different cart styles which may be encountered can be a very expensive approach to a widespread problem.

The above-referenced U.S. Pat. No. 4,613,271 to Naab seeks to address one aspect of such problems by providing a device which is capable of emptying different style garbage containers. Such arrangement involves providing on a single unit both a clamping mechanism for grasping a molded upper lip of European style carts and opposing engagement members for engaging paired lift engagement members of a domestic style cart. See cart 50 of FIG. 3 and cart 55 of FIG. 4, respectively, of the Naab patent. Naab uses a gravity or spring system in conjunction with an upper gripper 37 to permit the gripper to be pivoted out of the way for operation of a clamp mechanism whenever a European style cart is presented. At the same time, Naab provides a lower cart engagement member which is pivoted generally in the same direction as the above-described prior art arrangements for lifting domestic style carts. In other words, the lower engagement member of Naab is pivoted upwardly into a retracted position during dumping of European style carts, but pivoted downwardly into an extended position against the relatively uppermost side of the lower lift engagement member of a cart whenever a domestic style cart is being dumped.

The Naab arrangement utilizes a spring 45 for biasing a locking hook 44 into an upwardly pivoted or retracted position. Naab then uses various arrangements for overcoming such biasing and positively moving locking hook 44 outward and downward into engagement with a lower lift bar whenever a domestic style cart is being dumped.

In some embodiments, Naab uses a specific turn-on/turn-off device keyed by a switch actuator 67 which itself is actuated by contact from gripper 37. Electric, hydraulic valve, or mechanical means may be associated with such switch actuator 67 for changing the position of an adjustable settable sleeve. Naab FIG. 8 illustrates an electromagnetic switchable version while Naab FIG. 9 illustrates a fluid power (e.g., hydraulic) arrangement.

In some embodiments, such as that shown in FIGS. 12 through 15, Naab uses a counterlocking device for placement of the locking hook depending on the movement of other members (for example, gravity arm 87) during operation of the lift.

With respect to relative size considerations, the thickness of the overall Naab lift (i.e., the distance between where it is supported and the point at which a cart is engaged to be picked up) must necessarily accommodate the different mechanisms by which the Naab device functions in order to advance locking hook 44 outward and downward towards a lower lift bar. Such arrangement therefore serves as one limitation to minimizing such lifter thickness.

Another aspect of Naab is that the top clamp 35 of Naab for clamping European style carts is in a relatively fixed position and the cart molded lip is brought into contact with the lower side of element 35, as a carrying element 33 is positively moved upward from beneath the cart lip. Such an arrangement encompasses a certain minimum required mechanical operations, which again necessitates a certain thickness for the Naab lifter.

In addition to the strong need and desire for an efficient lifter which has universal features for lifting carts of different styles (i.e., domestic or European style carts), it is also a fact that carts of different sizes, and hence often times of different heights, are encountered on a residential refuse collection run, not to mention the variety encountered in other settings. The need arises to match the physical characteristics of a lifter with the size of the container to be dumped. If the initial engagement feature of the lifter is below the uppermost engagement feature of the cart, potentially dangerous operations can ensue since the lifter might be actuated into a partially raised and/or partially inverted position before the cart is properly or fully (i.e., safely) engaged. On the other hand, if the uppermost engagement feature of the lifter is above the uppermost engagement feature of the cart, then the cart must somehow be lifted upwardly until engagement is made, which may be literally impossible to do manually whenever carts have loads therein upwards of 200 pounds. At the very least, repeated such manual operations can give rise to physical stresses and injuries of operators.

In addition to the foregoing, it is desirable to have smooth, stable operations during a dumping cycle. Instability can come about for a variety of reasons. For example, a load of 200 pounds on the end of extended arms can exert tremendous torque forces if the load is not balanced. Hence, any lateral looseness in a lift system could be an area of concern for a long term maintenance problem.

Also, the speed and smoothness of lift operations are important. For example a jerking (i.e., non-smooth) motion of a 200 pound weight on the end of extended arms can create maintenance problems (and even arm breakage) over time. Potentially adverse consequences of jerking can peak whenever the lift arms are most extended, i.e. whenever the cart is fully raised and inverted for dumping the contents thereof. Motion dampening at such moment could serve to limit or reduce wear and strain on both the cart and the lifter.

The entire disclosures of the U.S. patents noted above are herewith incorporated by reference into the subject disclosure.

SUMMARY OF THE INVENTION

The present invention recognizes and addresses various of the foregoing problems, and others, concerning receptacle dumping apparatus and their operations. Thus, broadly speaking, a principal object of this invention is to provide improved receptacle dumping apparatus. More particularly, a main concern is improved cart lifters for use with different style residential refuse collection carts.

It is another particular object of the present invention to provide receptacle dumping apparatus which automatically adjust to different height containers to be lifted and dumped, while also automatically adapting to different style carts (i.e., different arrangements for lift engagement features).

Another specific object is improved stability and long term maintenance during operations, as for the lifter and as for the cart itself.

Still another present object is to provide an apparatus which facilitates different placements of such improved lifting apparatus on refuse collection vehicles (such as at rear, side, or front end box positions) or which provides for improved usage in conjunction with relatively larger container boxes into which roll-out receptacles are to be dumped. It is a more particular object to provide such an improved apparatus which likewise further accommodates secondary dumping steps of the relatively larger container box, by being of adequately small size and weight to be processed through the dumping cycle (i.e., carried on the larger container box as it is dumped).

Still a further more particular object is to provide improved apparatus which renders more efficient various refuse collection vehicle operations, including eliminating certain manpower requirements while also increasing relative safety. At the same time, it is desired to make more efficient residential refuse collection operations by reducing the time involved for various dumping cycles, especially when including the overall operator time.

It is a still further present object to provide improved refuse collection vehicle usage, so that the same vehicle may be utilized for either residential or commercial collection routes.

Still further, a present object is to provide such an improved apparatus which is also of relatively reduced size (without reduced capacity) so as to broaden applications of such lifter (i.e., make same usable more efficiently and in more situations than prior lifters). At the same time, it is desired to make such an improved lifting apparatus which is relatively lighter than prior units, while also being more compact.

Yet another present object is to lessen the stress and strain applied to both cart and lifter due to the relative harsh handling sometimes otherwise accorded thereto.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitution of equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description). One exemplary such embodiment of the present invention relates to a lifting apparatus for use with different size residential refuse collection carts, for lifting and dumping the contents thereof into a larger refuse container. Such apparatus comprises a lift plate for receipt thereon of a refuse collection cart to be emptied; drive means for controllably moving the lift plate with a refuse collection cart received thereon so as to lift and dump the contents of such cart; cart engagement means associated with the lift plate for engaging a cart to be emptied for movement thereof with the lift plate; and vertical adjustment means for relatively vertically shifting the position of the lift plate, drive means, and cart engagement means, between an initial null position thereof and a variable raised engaging position thereof at which the cart engagement means is positioned for engaging at least one predetermined lift engagement member on a cart to be emptied, such vertical adjustment means including at least one vertical guide member with a slip fit bushing movably associated therewith.

Such vertical adjustment means preferably further includes a pair of laterally spaced vertical guide rods with a respective pair of slip fit bushings received on each of such rods, with each of the bushing pairs enclosed by a tube with grease seal means on opposite ends thereof so as to form a greased annular cavity between the bushings of a respective pair thereof, for slip fit vertical travel thereof along its respective associated vertical guide rod.

A further embodiment may variously include the foregoing combined with present drive dampening means for selectively slowing controlled moving of the lift plate during a predetermined portion of a cart dumping cycle.

Another present exemplary embodiment concerns a lifting apparatus for use with residential refuse collection carts, for lifting and dumping the contents thereof into a larger refuse container, such apparatus comprising a lift plate for receipt thereon of a refuse collection cart to be emptied; drive means for controllably moving the lift plate with a refuse collection cart received thereon so as to lift and dump the contents of such cart; cart engagement means associated with the lift plate for engaging a refuse collection cart to be emptied; and drive dampening means for selectively slowing the controlled moving of the lift plate during a predetermined portion of a cart dumping cycle, so as to reduce strain on a cart during final dumping thereof.

Yet another construction comprising a present exemplary embodiment includes a piston responsive variable valving system for operation with a fluid activated piston movably received within a cylinder, such system comprising fluid port means associated with one end of a cylinder for conducting fluid in alternate directions in the cylinder for driven movement of a piston therein; fluid flow rate regulating means received within the fluid port means for establishing one of at least two different fluid flow rates for fluid conducted therethrough so as to drive the piston, under a given load condition, at two different corresponding speeds within the cylinder, such regulating means including a movable actuation member, movement of which between respective first and second positions thereof respectively and correspondingly selects the different fluid flow rates; and biasing means, for biasing the movable actuation number into the first position thereof protruding into the cylinder and in the travel path of the piston movably received therein so as to select a corresponding first fluid flow rate through operation of the regulating means, and for permitting the movable actuation member to be moved into the second position thereof responsive to engagement with the piston so as to select a corresponding second fluid flow rate through operation of the regulating means.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
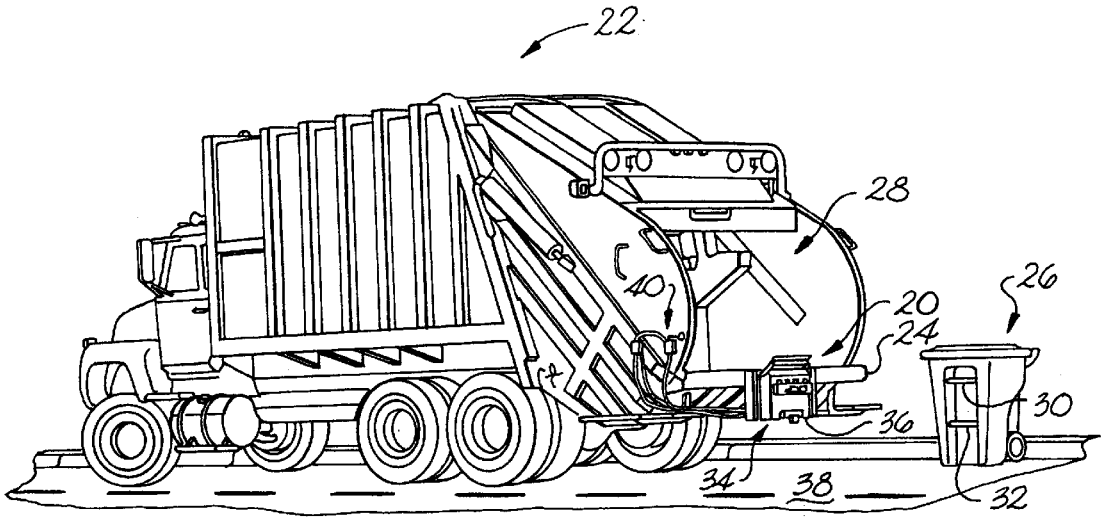
FIG. 1 is a perspective view of an exemplary rear load refuse collection truck shown in combination with an exemplary lifter in accordance with the subject invention and one exemplary style of a conventional cart for residential refuse collection.

Repeat use of reference characters throughout the present specification and appended drawings is intended to represent same or analogous features or elements of the invention.

DETAILED DESCRIPTION OF THE PREFERRED EMBODIMENTS

It will be understood throughout the subject specification that different uses and applications of the subject invention may be practiced, in conjunction with modifications and variations of specific features within the spirit and scope of the invention. The disclosure herewith is suggestive of various alternatives, but does not attempt to set forth all possible variations.

FIG. 1 illustrates an exemplary lifting apparatus for receptacle dumping apparatus generally 20 mounted on an exemplary rear load refuse collection truck generally 22. One or more of lifting devices 20 may be secured to a rear area such as bumper 24 of truck 22 for emptying the contents of a residential refuse collection cart generally 26 into a rearward opening generally 28 of truck 22. As well known to those of ordinary skill in the art, cart 26 is generally of the above-referenced domestic design, and includes a pair of opposing latch engagement surfaces 30 and 32 by which the cart is engaged, raised, and dumped.

Lifting apparatus 20 in accordance with such exemplary embodiment of the subject invention has a relatively shortened face plate area generally 34 so that there is a substantial amount of clearance between the bottom portion 36 of lifter 20 and the road surface 38. Such relatively compact size permits advantageous use of lifter 20 in other arrangements, such as side truck mounts or container box mounting arrangements, as discussed below. An operator hand valve 40 may be used for controlling the flow of hydraulic fluid to lifter 20.

Figure 2B:
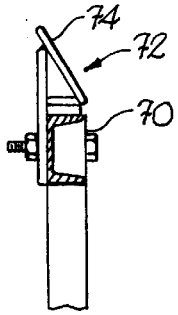
FIG. 2B is an enlarged isolated view of a portion of the FIG. 2A arrangement illustrating kickplate features in accordance with this invention.
Figure 2A:
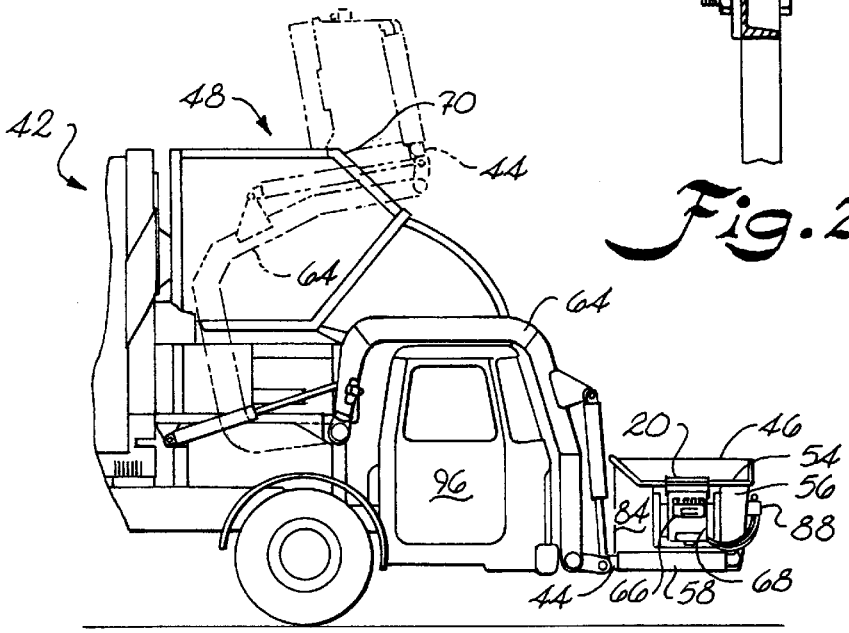
FIG. 2A is a partial side view of a second style of refuse collection truck comprising a front load box arrangement in accordance with an exemplary embodiment of the subject invention.
Figure 3:
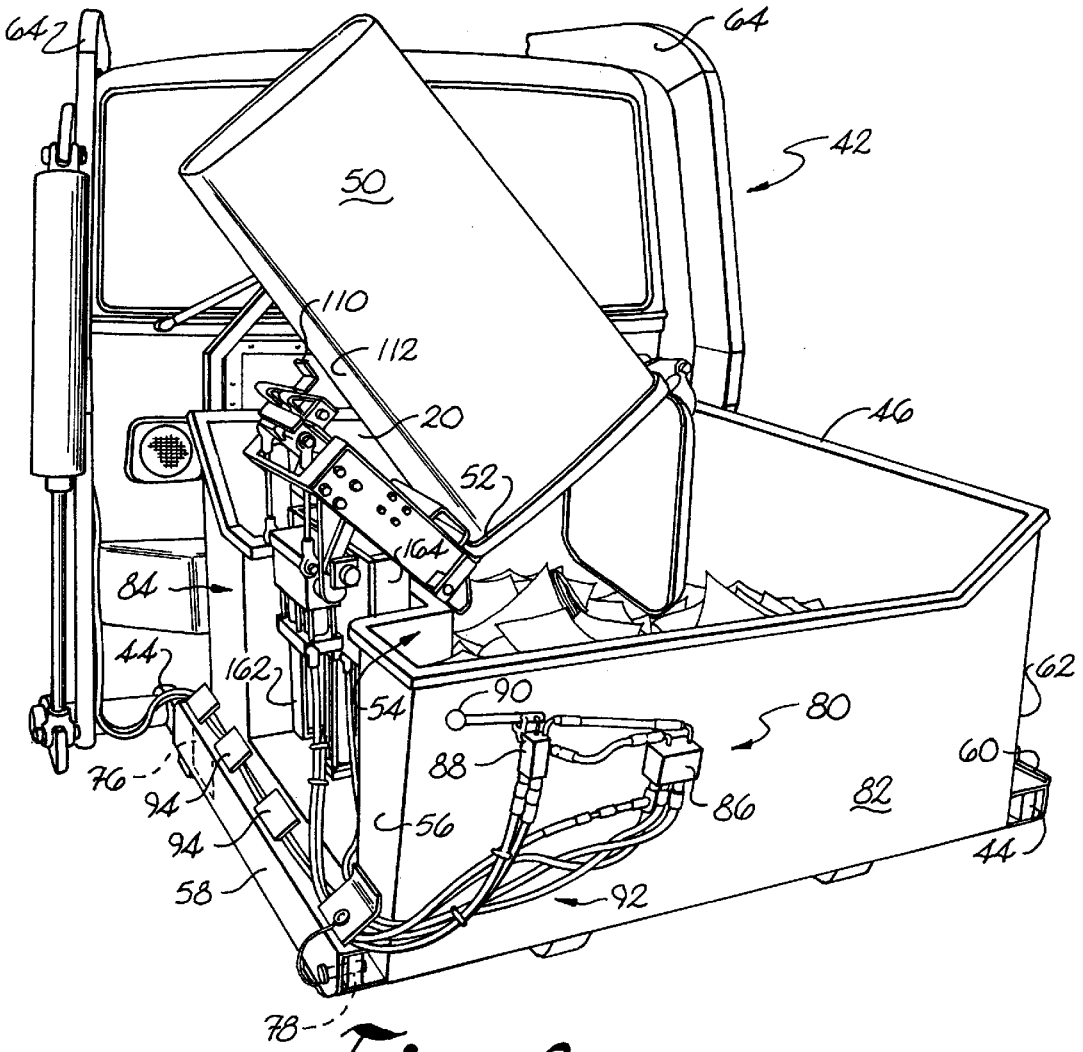
FIG. 3 is a generally forward perspective view of the arrangement of present FIG. 2A, and illustrating operation of an exemplary embodiment of the subject invention in the process of dumping a second exemplary style of conventional cart for residential refuse collection.

FIG. 2A represents a partial side view of a second style of refuse collection truck generally 42, which is also shown in a generally forward perspective view in present FIG. 3. Such truck has a pair of front forks 44 for raising and dumping a relatively larger container box 46 into a refuse hopper having an upper opening generally 48.

Container box 46 may be provided in accordance with the subject invention with a lifting apparatus 20 mounted thereon. While different forms of lifters may be utilized in the present arrangement, the subject lifter 20 advantageously comprises a combination cart lifter per the subject invention for automatically engaging and lifting residential refuse collection carts of different styles having either one or two lift pickup points. For example, lifter 20 can be used with a domestic style can 26 having two pickup points 30 and 32, or with a European style can generally 50 (FIG. 3) having a single lift pickup point such as molded lip 52.

Container box 46 in accordance with the subject invention in general comprises a front end load container box having a substantially open top into which refuse from residential collection carts is dumped for subsequent dumping into hopper 48. A relatively recessed lifter mounting area 54 is provided on one lateral side 56 of box 46. In such area, a lifter 20 or other present lifter embodiment is mounted, as discussed below. A pair of fork channels 58 and 60 are provided on opposing lateral sides 56 and 62 of box 46 for support of such box on the front forks 44 of the top loading refuse collection truck 42. With such arrangement, refuse dumped into container box 46 may be subsequently dumped into hopper 48 of truck 42.

While container box 46 may comprise various sizes, such as holding anywhere from about 1 to about 3 cubic yards of refuse, it is preferred that box 46 be matched with the size of hopper opening 48 so as to maximize the amount of refuse dumped in a given dumping cycle utilizing the large dump arms 64 of truck 42.

Present FIG. 2B is an enlarged isolated view of a portion of the FIG. 2A truck arrangement illustrating certain present kickplate features in accordance with this invention which further serve to maximize dumping efficiency in the following manner. More specifically, as discussed in detail below, lifter 20 includes thereon a hinged or pivoting saddle generally 66 which projects outwardly from the front of face plate 68. As box 46 is dumped (dotted line illustration of present FIG. 2) such projecting hinged saddle would tend to interfere with an upper portion of a near wall 70 forming hopper opening 48. A kickplate 72 is shown in partial cross section in present FIG. 2B as having an angled surface 74 which is positioned on wall 70 so as to engage projecting lift saddle 66 and pivot same into a retracted position as the container box 46 is dumped carrying the lifter 20 thereon. Such an arrangement permits the container box size to be relatively maximized resulting in minimized container box dumping cycles.

The fork channels 58 and 60 may include therein guide means comprising internal angled plates 76 or the like for relatively tightening the fit of the truck front forks 44 therein. Similarly, removable pins 78 or the like may be provided for further securing the position of the fork distal tips. The purpose of such features is to prevent relative movement (particularly in the lateral direction) of the container box 46. For example, the lateral width of the hopper opening 48 may typically be about 80 inches, while the total lateral width of box 46 may be made in accordance with the subject invention to be about 78 inches. Typically the outside lateral distance of forks 44 is fixed at 77.5 inches. Those of ordinary skill in the art will understand that maximizing size of hopper 46 therefor necessarily involves very close tolerances during the dumping cycle. Use of the above-referenced guide means and tightening features in accordance with this invention therefore contributes to maximizing efficiency, as does use of the kickplate features 72 in combination with a lifter 20 in accordance with the subject invention.

As will be discussed in greater detail below with reference to FIGS. 16A through 19, a hydraulic drive circuit generally 80 as shown in FIG. 3 may be mounted on box 46. FIG. 3 illustrates an exemplary position thereof on a forward wall 82 of box 46. Other locations may be practiced in accordance with the subject invention, such as surface area 84 on lateral wall 56.

To provide certain cycle control means features in accordance with the subject invention, a dual sequencing valve 86 may be provided in combination with an operator control valve 88 having a single operator control handle 90. Various fluid lines generally 92 such as for passing hydraulic fluids or the like may be routed around and under protective plates 94 back towards interconnections on truck 42 with a source of pressurized fluid. Such interconnections may be of a quick disconnect type, to permit the box 46 to be quickly released from forks 44, permitting truck 42 to be used on other collection routes where already filled or partially filled refuse collection boxes will be engaged by forks 44 and dumped. Therefore, the present arrangement permits highly efficient alternative usage of relatively expensive truck 42.

In addition, the advantageous arrangement of present FIGS. 2A and 3 results in considerable manpower savings and improved operator safety. More specifically, a rear load truck such as 22 typically has a separate driver and lift operator (or operators where more than one lift is utilized). There are certain safety concerns whenever a lift operator is functioning at the rear of a large truck, such as truck 22.

By comparison, the arrangement of present FIG. 2A in accordance with the subject invention makes use of the thickness, size, and weight advantages (i.e., the compact features) of lifter 20 for providing a front end load box location. With such an arrangement, only the driver of truck 42 is needed since he can bring the box 46 into a position adjacent a curb side cart, step down from doorway 96 and operate lifter 20. It has been estimated that such an arrangement saves 3,000 to 4,000 operator steps per day, while also improving overall safety of operations. The movement savings alone account for a tremendous time savings in the overall route operations, including the improved route flexibility for truck 42 in accordance with further aspects of the subject invention. For example, the same truck 42 may be used during the day for residential duty (using container box 46 in accordance with the invention) and at night time on a commercial run route (with box 46 removed) for dumping commercial containers.

Figure 4:
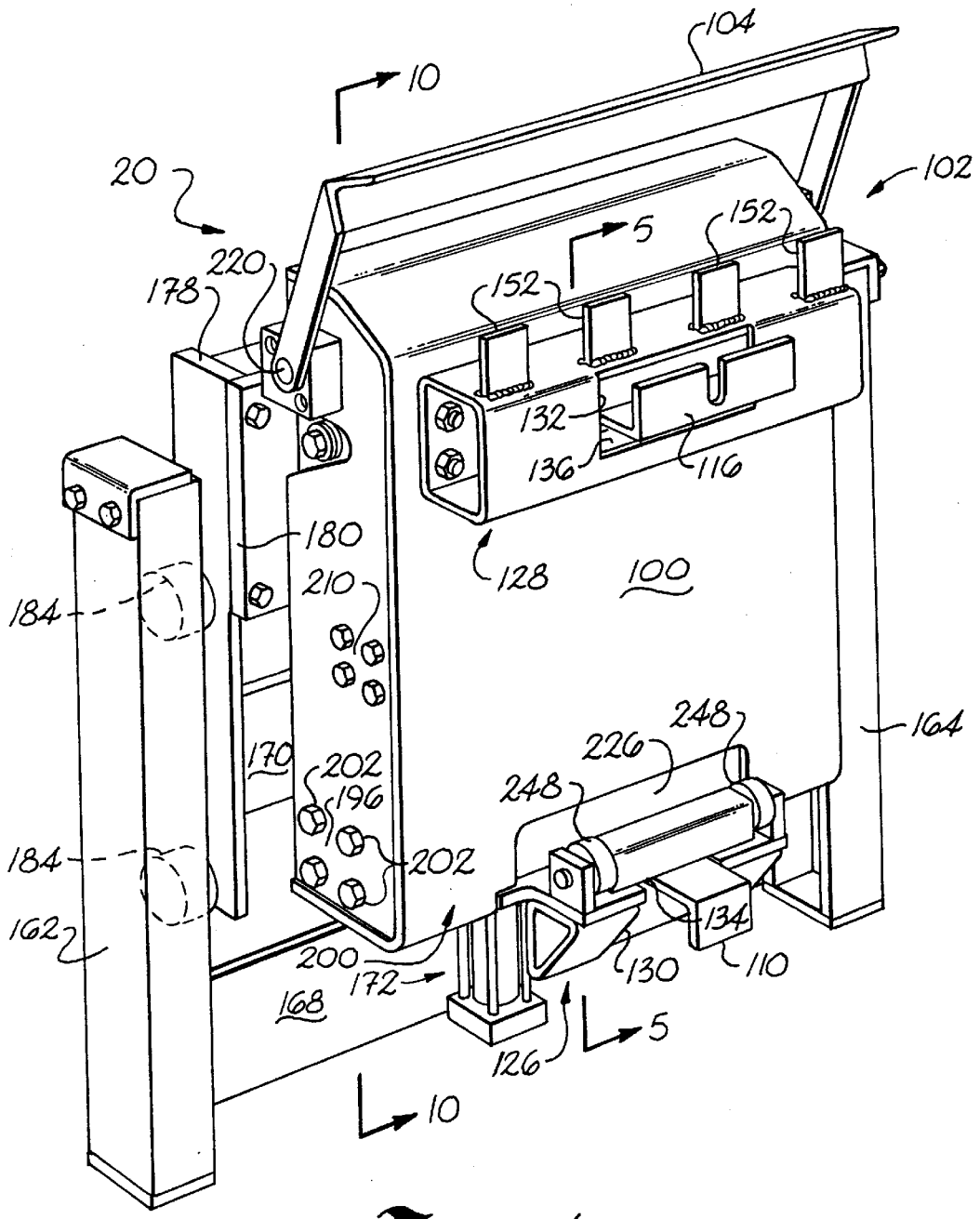
FIG. 4 is a generally front perspective view of an exemplary embodiment in accordance with the subject invention.
Figure 5:
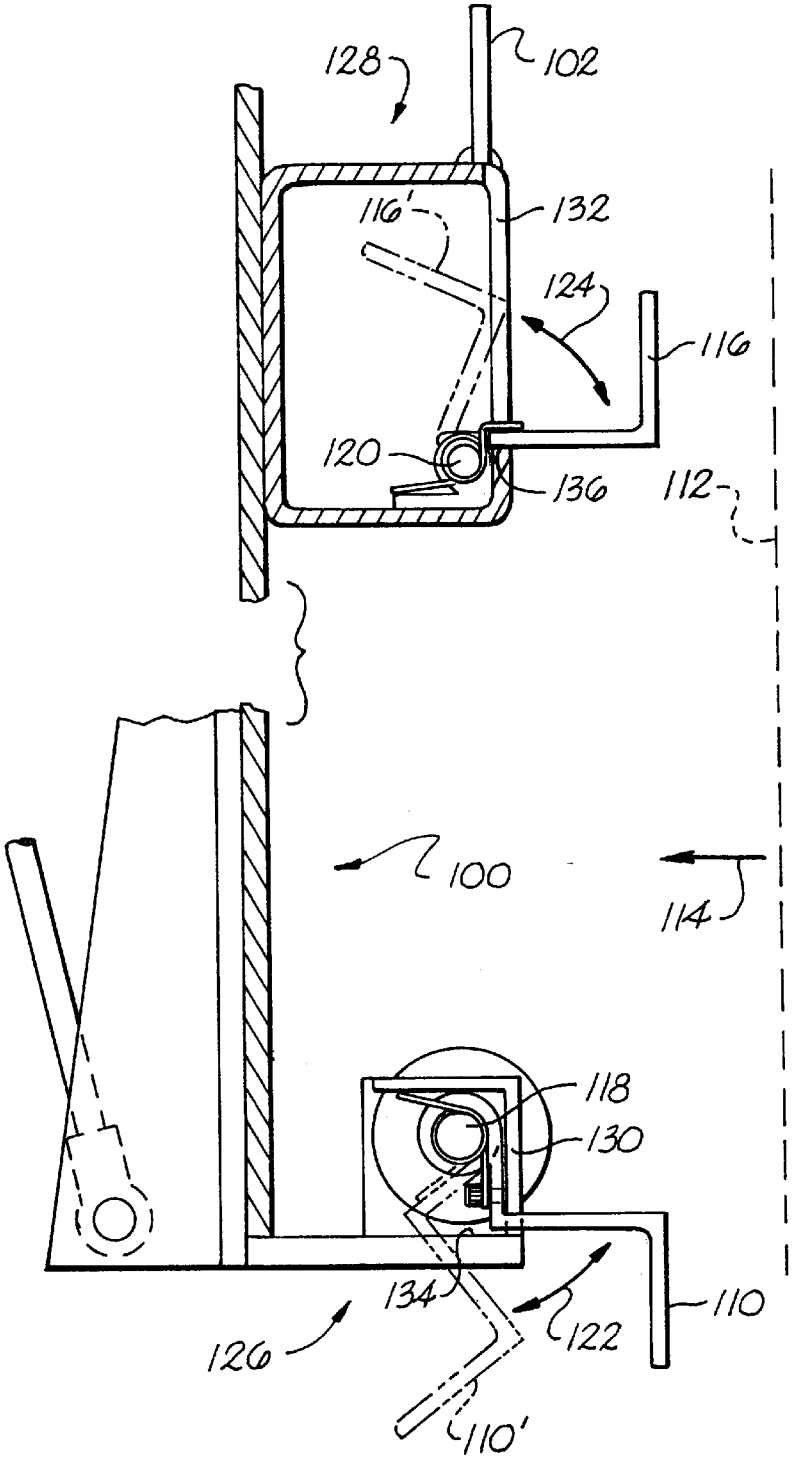
FIG. 5 is an enlarged partial cross-sectional view of portions of the embodiment of present FIG. 4, taken along sectional line 5—5 therein.
Figure 10:
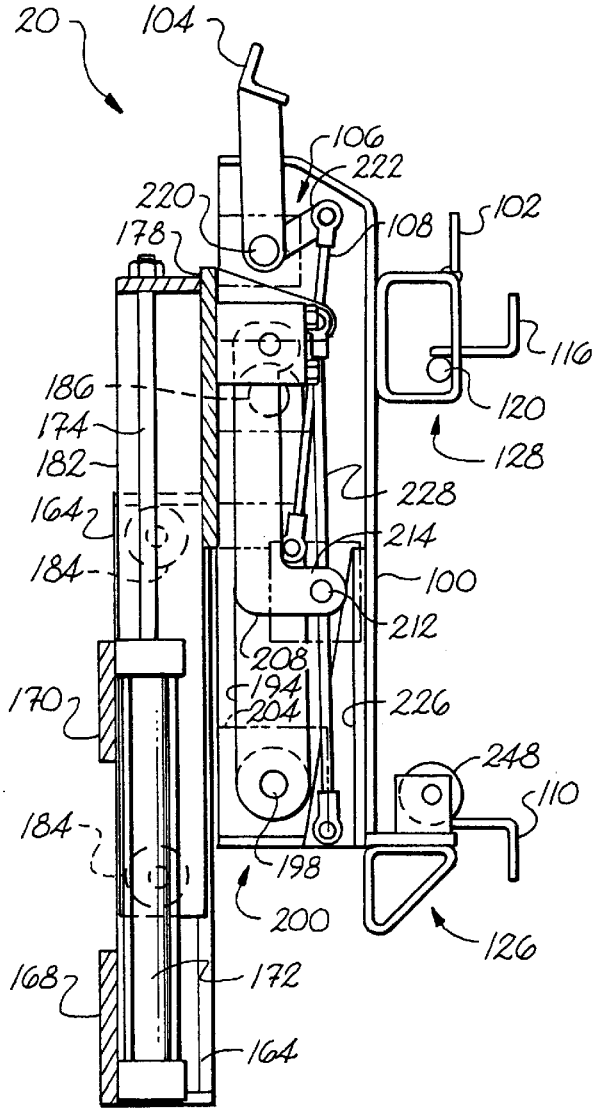
FIG. 10 is a cross-sectional view of an exemplary embodiment in accordance with the subject invention as shown in FIG. 4, taken along the sectional line 10—10 therein.

Present FIG. 4 is a generally front perspective view of an exemplary embodiment generally 20 of a lifting apparatus or receptacle dumping apparatus in accordance with the subject invention. FIGS. 5 and 10 represent specific cross-sectional views thereof taken along the respective sectional lines 5—5 and 10—10 as indicated in such FIG. 4.

Lifter 20 comprises a combination cart lifter for automatically engaging and lifting residential refuse collection carts of different styles, as explained hereinafter. A lift plate or main face plate 100 is provided for receiving thereon a refuse collection cart to be emptied. Lift plate 100 is movable between a lowered upright position thereof (which is the position illustrated in present FIG. 4) for receipt of a receptacle or cart and a raised inverted position thereof, discussed in greater detail below) for dumping the contents of the received cart. Drive means are provided for moving lift plate 100 between such respective positions, and may comprise a variety of actuating arrangements. One preferred exemplary embodiment comprises a hydraulically actuated rotary motor, and may comprise such an arrangement as examples of are disclosed in U.S. Pat. No. 4,773,812 to Bayne et al., herein fully incorporated by reference.

Various cart engagement means in accordance with the subject invention are associated with lift plate 100 for engaging a cart to be emptied for movement of such cart with lift plate 100. In a preferred combination cart lifter, such cart engagement means comprises both cart clamping means for clamping on lift plate 100 a refuse collection cart of the type having a single upper lip to be clamped during lifting, such as cart 50 in present FIG. 3, and further includes cart latching means for latching on lift plate 100 a refuse collection cart of the type having a pair of opposing latch engagement surfaces, such as cart 26 of present FIG. 1. Other present designs may include only one or the other means for engaging a cart, when combined with other present features.

Present cart clamping means in accordance with the subject invention may comprise a lower clamping member generally 102 relatively fixedly carried on lift plate 100 for engaging a relative lower side of a single lip 52 of cart 50. Such cart clamping means further includes an upper clamping member generally 104 supported in relatively movable relationship with lift plate 100 for engaging a relatively upper side of the cart single lip 52. Further provided are clamp actuation means generally 106 for closing clamp bar 104 towards lip 52. By providing such a movable clamp bar 104, clamping of cart lip 52 occurs at a relatively earlier point in time during a dumping cycle than it otherwise would, providing certain specific advantages discussed below.

The clamp actuation means 106 (See FIG. 10) includes at least one linkage generally 108 between movable upper clamping member 104 and other members which move during the dumping cycle, thereby providing movement of clamp arm 104 as discussed below.

Exemplary cart latching means in accordance with the subject invention includes a lower latch member generally 110 movably mounted between an extended position thereof (solid line illustrations of present FIGS. 4, 5, and 10) for engaging the lower of cart latch engagement surfaces for domestic style carts and a retracted position thereof (dotted line illustration 110' of present FIG. 5) pivoted relatively downward from its extended position. Such pivoting into a retracted position automatically occurs in response to engagement of a European style cart 50. Such a cart presents to lift plate 100 a generally smooth or flat side surface 112 which advantageously in accordance with the subject invention functions to push engagement member 110 into its retracted position. Such surface 112 is illustrated in dotted line in present FIG. 5 as it would be approaching lip plate 100 in the direction of arrow 114. While present FIG. 3 illustrates dumping of such European style cart 50, the engagement member 110 shown in such FIG. 3 is in its relatively extended position to show that surface 112 may become slightly pivoted away from lift plate 100 at the peak of the dumping cycle (i.e., the fully raised inverted position of cart 50). As shown, lower latch or engagement member 110 may comprise a substantially L-shaped member regarded as comprising a latching or a lift hook.

Exemplary cart latching means in accordance with the subject invention may further include an upper latch member generally 116 which is likewise movably mounted between an extended position thereof (a solid line illustration of present FIGS. 4, 5, and 10) for engaging the upper of cart latch engagement surfaces of domestic style carts and a retracted position thereof (dotted line illustration 116') pivoted relatively upward from its extended position. Again, member 116 preferably is pivoted into its retracted position 116' by presentation of smooth surface 112 of a European style cart (see FIG. 5).

Both lower and upper latch members 110 and 116 are preferably biased into their respective extended positions (solid line illustrations of present FIGS. 4, 5, and 10) so as to engage and lift a domestic style cart of the type having a pair of opposing latch surfaces, as noted above. However, advantageously in accordance with the illustrated exemplary embodiment of the subject invention, such members are pivoted into their respective retracted positions upon contact with surface 112 of a European style or other style cart to permit such cart to be engaged and otherwise lifted with apparatus 20 (such as with the cart clamping means described above).

While member 110 may be regarded as comprising a hinged hook, the upper member 116 may be regarded as comprising a latching or lift saddle. Both such members are preferably rotatably mounted on respective spring-loaded shafts 118 and 120. Other forms of resilient and pivotable mounting may be practiced in accordance with the broader aspects of the subject invention, so long as engagement members 110 and 116 are generally movable in the direction of respective double-headed arrows 122 and 124 (see FIG. 5).

Latch members 110 and 116 are preferably associated with respective mounting brackets generally 126 and 128. Such brackets include respective openings therein 130 and 132 into which their respective latch members are pivoted when in their retracted positions. Respective housing surfaces 134 and 136 adjacent such housing openings help support respective engagement members 110 and 116 in their extended positions. With such an arrangement, the engagement members are adequately rigid for performing their grasping functions during the dumping of appropriate styles of carts.

Figure 6A:
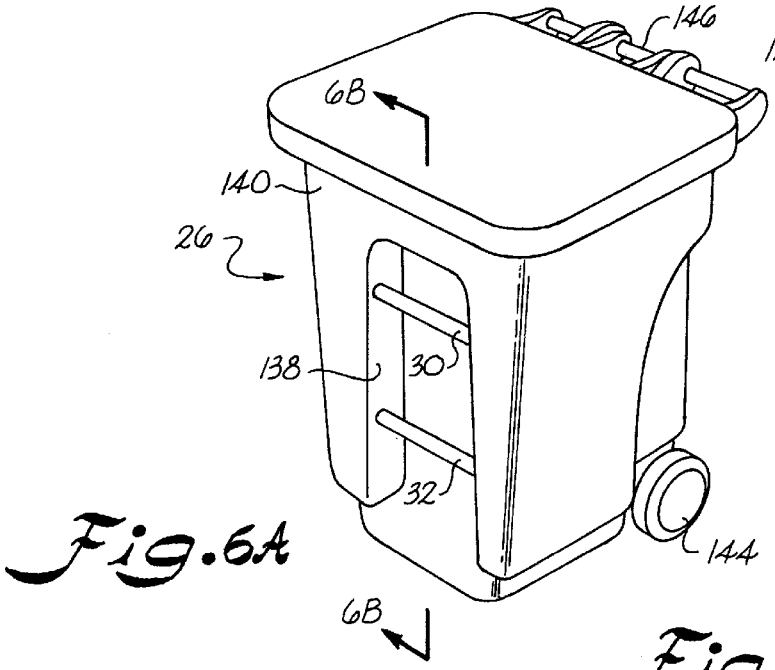
FIG. 6A is a generally forward perspective view of a first exemplary conventional cart for residential refuse collection.
Figure 6B:
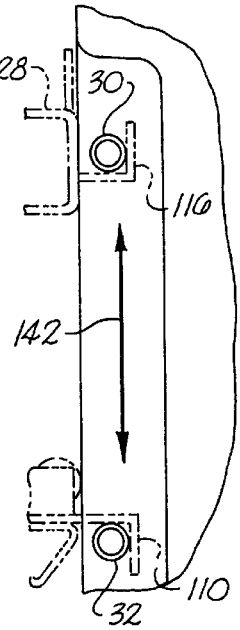
FIG. 6B is a partial cross-sectional view of the conventional cart of FIG. 6A shown in use with certain exemplary features in accordance with the subject invention (illustrated in dotted line), taken along the sectional line 6B—6B of such FIG. 6A.

Present FIG. 6A is a generally forward perspective view of a first exemplary conventional cart generally 26 as comprising the above-referenced domestic style cart. Cart 26 has a pair of lift engagement members comprising bar 30 and 32 which are engaged by respective members 116 and 110 in accordance with the subject invention. Present FIG. 6B illustrates such engagement by representing a partial cross-sectional view of receptacle 26 taken along sectional line 6B—6B of present FIG. 6A. Cart features are illustrated in solid line while lifter features in accordance with the subject invention are illustrated in dotted line in present FIG. 6B.

As shown, the outwardly projecting or extending position of latch members 110 and 116 penetrates a recessed area 138 in the face 140 of cart 126. The vertical axis of such cart 26 runs in the direction of double-headed arrow 142 of present FIG. 6B. As discussed below in detail, latch engagement members 110 and 116 are moved respectively and oppositely in axially outward directions along axis 142 so as to engage bars 30 and 32 as illustrated in present FIG. 6B. As represented in present FIG. 5, axially outward forces along axis 142 rotate latch members 110 and 116 into their respective retracted positions.

Figure 7A:
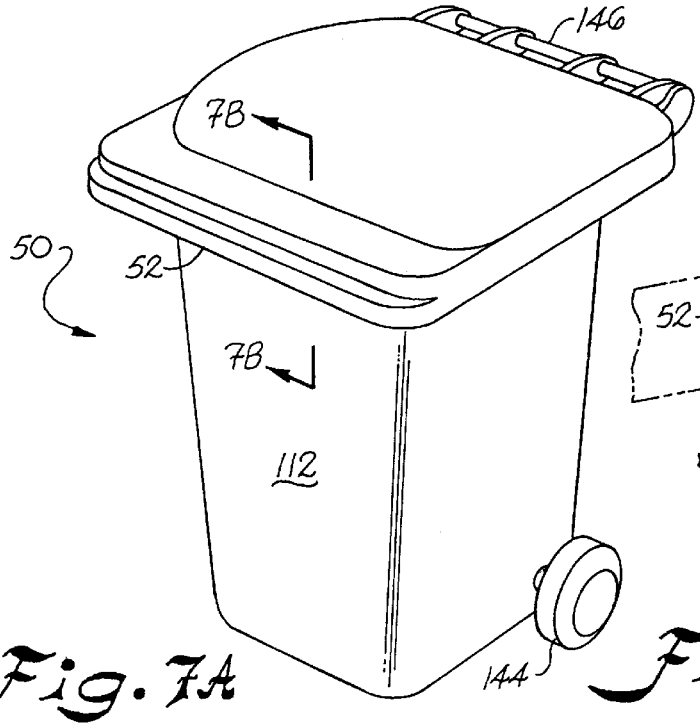
FIG. 7A is a generally forward perspective view of a second exemplary conventional cart for residential refuse collection.

Present FIG. 7A is a generally forward perspective view of the second exemplary conventional cart comprising a European style cart generally 50, having a molded or reinforced upper lip 52 and a relatively smooth side surface 112 in place of the recessed region 138 of cart 26. Both carts 26 and 50 have wheels 144 or similar and handles 146 by which a resident rolls the cart to a generally curb side location for truck pickup.

Figure 7B:
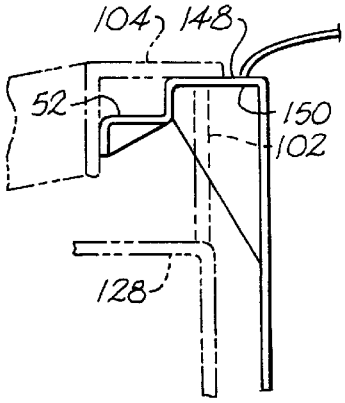
FIG. 7B is a partial cross-sectional view of the conventional cart of FIG. 7A shown in use with certain exemplary features in accordance with the subject invention (illustrated in dotted line), taken along the sectional line 7B—7B of such FIG. 7A.

Present FIG. 7B is an enlarged partial cross-sectional view of cart 50 (shown in solid line) illustrated in use with certain exemplary features in accordance with the subject invention (which are illustrated in dotted line in FIG. 7B), taken along the sectional line 7B—7B of present FIG. 7A. As illustrated, movable clamp bar 104 in accordance with this invention engages the relatively upper side 148 of cart lip 52 while relatively fixed engagement member 102 in accordance with this invention engages a lower side 150 of lip 52. As will be understood by those of ordinary skill in the art from the present disclosure, the upper engagement member or lift saddle 116 in accordance with cart latching means of the subject invention is pivoted into a retracted position so as to not interfere with lip 52 being brought into clamping arrangement with present cart clamping means. The actuation of such clamping features and timing thereof is discussed in greater detail below, by which an appropriate clamping effect takes place without overcrushing or underclamping lip 52. Clamping members 102 may comprise different embodiments such as relative finger bar elements 152 of present FIG. 4. Other configurations may be practiced. For example, engagement members of other predetermined shapes may be provided for mating with pockets of corresponding predetermined shapes carried on a top portion or upper side surface of other appropriate cart designs.

FIGS. 8A through 8D are respective side elevational view of the exemplary cart of present FIG. 6A shown in combination with an exemplary embodiment generally 20 of a lifting apparatus in accordance with the subject invention. FIGS. 8A through 8D illustrate in sequence a portion of a dumping cycle in accordance with this invention, including representing use of certain present optional vertical lift assembly features generally 154.

Vertical adjustment means generally 154 are provided in accordance with the subject invention for relatively vertically shifting the position of lift plate 100 and features associated therewith between an initial null position thereof and a variably raised engaging position thereof at which various cart engagement features of the subject invention are positioned for engaging at least one predetermined lift engagement member on a cart to be emptied.

Figure 8A:
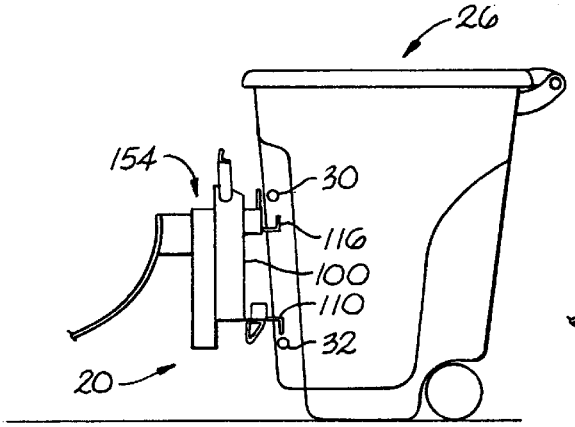
FIGS. 8A through 8D are respective side elevational views of the exemplary cart of present FIG. 6A shown in combination with an exemplary embodiment in accordance with the subject invention, and illustrating in sequence a portion of a dumping cycle in accordance with this invention, including representing use of certain present optional vertical lift assembly features.

FIG. 8A illustrates an exemplary such null position of the vertical adjustment means. As illustrated, the upper latching member 116 is situated well below the height of upper engagement bar 30 of cart 26. Without any actuation of drive means for controllably moving lift plate 100 towards its raised position, the vertical adjustment means 154 begins to raise the lift plate 100 and related features, as shown in FIG. 8B.

Figure 8B:
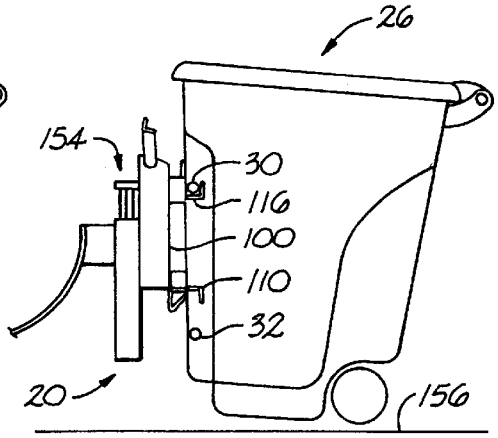

FIG. 8B represents a point in the overall dumping cycle of an exemplary embodiment generally 20 wherein the vertical adjustment means has raised lift plate 100 and associated member upper latch 116 a variable height for engaging bar 30. Because of different cart sizes, the initial height of bar 30 is generally unknown. However, as explained below, cycle control means in accordance with the subject invention, for example, various hydraulic sequencing valves, permits upward movement of lift plate 100 until bar 30 is engaged and cart 26 is just slightly raised from surface 156 (as shown in FIG. 8B).

Figure 8C:
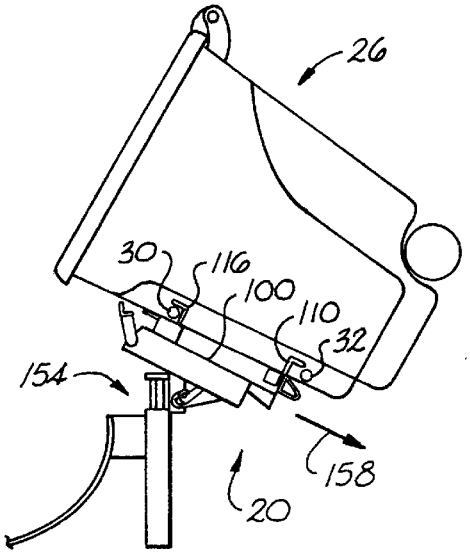

Once the cart engagement portion of the cycle as represented by FIG. 8B is completed, present cycle control means cause cessation of the vertical lifting with vertical adjustment means 154 and start of cart lifting and dumping with face plate 100 moved by the associated drive means. FIG. 8C represents such time period of the dumping cycle, and illustrates that latch element 110 is being moved generally in a downward longitudinal axis direction 158 so as to eventually engage bar 32 for holding cart 26 onto face plate 100.

Figure 8D:
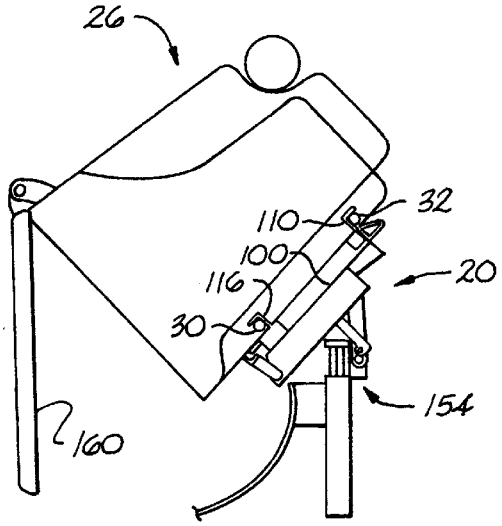

As the dumping cycle continues so that face plate 100 assumes its fully raised inverted position as shown in present FIG. 8D, lower latch member 110 becomes fully engaged with bar 32. Gravity causes the lid 160 of cart 26 to open for dumping the contents of such cart into a refuse collection vehicle or a container box such as exemplary box 46 of present FIGS. 2A and 3.

Present cycle control means associated with vertical adjustment means 154 and the drive means of lifter 20 first variably operates the vertical adjustment means 154 so as to engage the cart engagement means (latch 116) with at least one lift engagement member (bar 30) of cart 26 to be emptied, the height of which bar 30 is not specifically or initially known. Thereafter, cycle control means operates automatically the drive means so as to lift and dump the contents of the engaged cart, as shown.

Once the contents of cart 26 are dumped, the cycle represented by present FIGS. 8A through 8D is generally reversed. In other words, first the cart 26 is returned to its relatively lowered upright position shown in present FIG. 8B by reversing the movement of face plate 100. Once achieving the position of FIG. 8B, the vertical adjustment means are operated for again lowering the face plate 100 until the position of FIG. 8A is obtained. During the face plate lowering operations of FIGS. 8D through 8B, lower latch member 110 is in effect retracted in accordance with certain present face plate extension means features, as discussed in detail below.

FIGS. 9A through 9D are similar to FIGS. 8A through 8D, respectively, illustrating side elevational views of the present exemplary combination cart lifter 20, but with use thereof with the exemplary. European style cart 50.

The phases of the dump cycle are generally the same for representations of present FIGS. 9A through 9D as they are for respective FIGS. 8A through 8D. The chief difference is that smooth surface 112 of cart 50 has caused respective latch members 110 and 116 to be pivoted in axially outward directions (in relation to axis 142 of present FIG. 6B) into their respective retracted positions, thereby permitting lifting and dumping of cart 50 with present cart clamping means and clamp actuation means features.

Figure 9A:
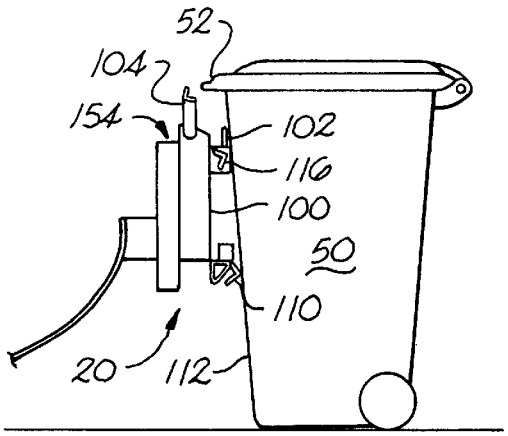
FIGS. 9A through 9D are respective side elevational views of the exemplary cart of present FIG. 7A shown in combination with an exemplary embodiment in accordance with the subject invention, and illustrating in sequence a portion of a dumping cycle in accordance with this invention, including representing use of certain present optional vertical lift assembly features.
Figure 9B:
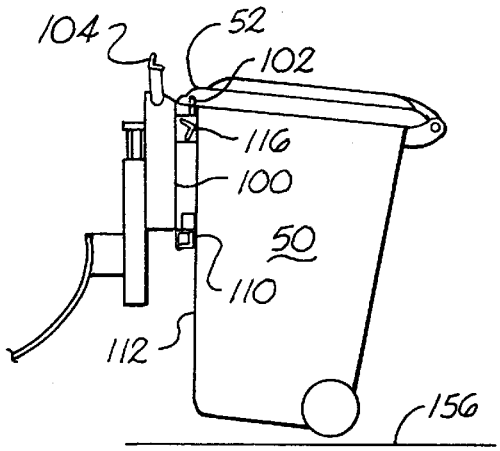
Figure 9C:
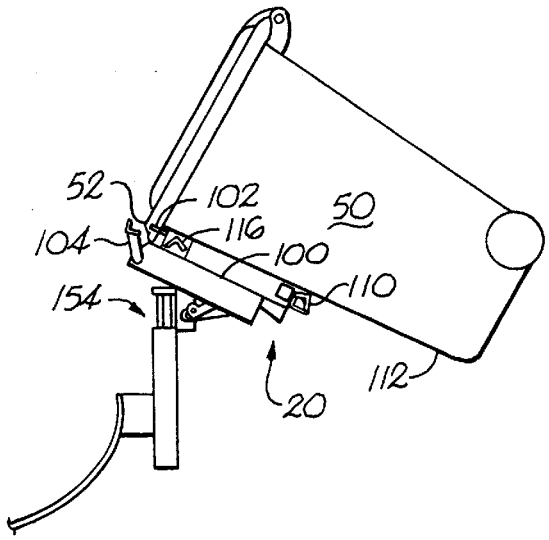
Figure 9D:
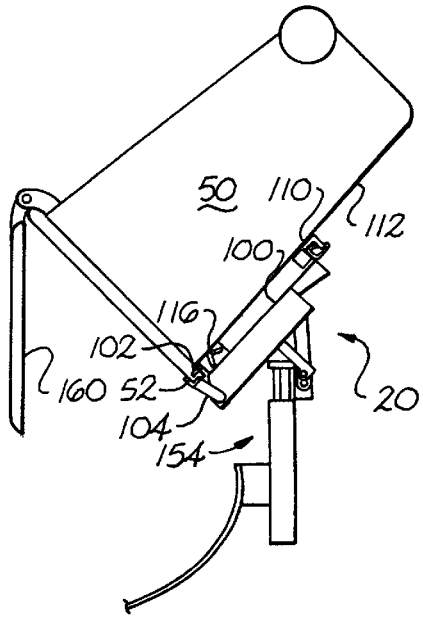

As further shown, operation of vertical adjustment means 154 causes engagement member 102 to become seated against the underside of lip 52 so that cart 50 is slightly raised from ground 156 (FIG. 9B). Thereafter, cycle control means or hydraulic sequencing features in accordance with the invention causes hydraulic drive power to be shifted from the vertical adjustment means 154 to the drive means so that face plate 100 begins to be moved towards its raised inverted position. Clamp actuation means, discussed in greater detail below, begin to cause movable clamp arm 104 to move towards the upper side of lip 52 and clamp same before the fully raised inverted position (FIG. 9D) is obtained. As well known to those of ordinary skill in the art, securement of both sides of lip 52 serves the same function relative cart 50 as respective single-sided engagement of the two opposing bar engagement elements 30 and 32 relative cart 26.

Once the contents of cart 50 are dumped (FIG. 9D) the cycle may again be reversed to the point of lowering cart 50 to its FIG. 9A position, in the same manner as discussed above with reference to FIGS. 8A through 8D. Also, similarly to the description of FIGS. 8A through 8D, the vertical adjustment means automatically variably raises lift plate 100 and corresponding engagement member 102 to an appropriate height for engaging the underside of lip 52, regardless of the initially unknown height of such lip above ground surface 156. Different heights of such lip 52 may be encountered due to differences between various manufacturers or differences in cart sizes.

Figure 14:
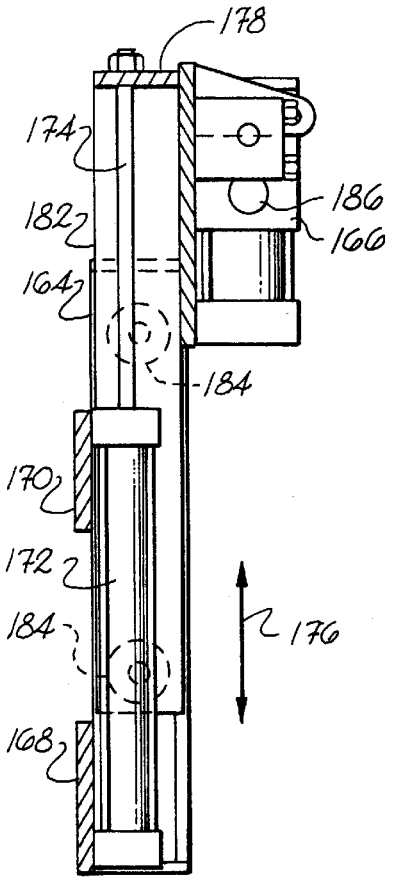
FIG. 14 is a partial cross-sectional view of the exemplary embodiment of present FIGS. 4 and 10 more particularly illustrating present optional vertical lift assembly features thereof.
Figure 11:
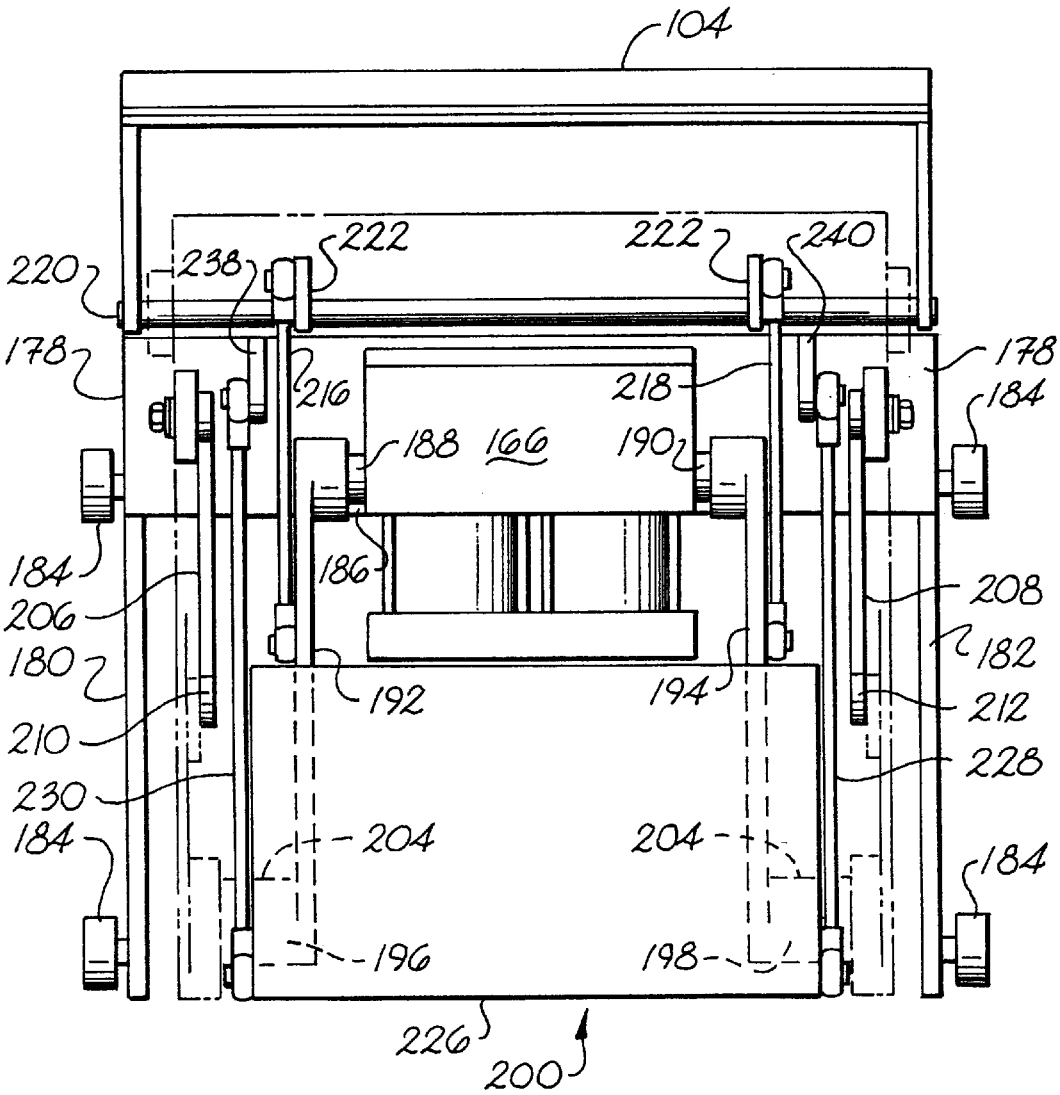
FIG. 11 is a generally rear perspective view of the embodiment of present FIG. 4, though without express illustration of certain present optional vertical lift assembly features.

FIG. 11 is a generally rear perspective view of the embodiment of FIG. 4 of a lift unit generally 20, though without express illustration of certain present optional vertical lift assembly features thereof. However, FIG. 14, is a partial cross-sectional view of the exemplary embodiment of present FIGS. 4 and 10 more particularly illustrating certain present optional vertical lift features thereof, as discussed hereinafter.

Vertical adjustment means (present optional vertical lift assembly features) in accordance with this invention may include a pair of laterally positioned and separate vertical guides 162 and 164 (see also FIG. 4). Such guides may directly be secured to a primary support such as a refuse collection vehicle or container box as represented in present FIG. 3. In either event, the lift plate 100 and drive means generally 166 (FIG. 14) are movably supported in relation to such vertical guides. A support element such as one or more generally horizontal crossing members 168 and 170 may be associated with the vertical guides for further strengthening the arrangement and for providing support of other features mentioned hereinafter.

A specific actuation device such as a hydraulic lifting cylinder generally 172 may be interconnected between the support elements 168 and/or 170 and the lift plate 100 and/or drive means 166. Actuation of the hydraulic lifting cylinder reciprocates an actuation rod 174 thereof for its movement along the direction of double-headed arrow 176 (FIG. 14). With such actuation movement, the drive means 166 and lift plate 100 (and any other features associated therewith such as latch members 116 and 110) are moved relative to the vertical guides 162 and 164.

Drive means 166 may in fact preferably be secured to a support frame 178 which may in turn further include a pair of generally vertical support elements 180 and 182 with roller elements 184 thereon, which roller elements 184 are received directly in the vertical guide channels 162 and 164.

Hydraulic drive circuit features operative with the above-referenced vertical lift assembly means and related features are discussed in greater detail below with reference to present FIGS. 16A through 19. In general, such hydraulic drive circuit is operative for first applying hydraulic drive power to hydraulic lifting cylinder 172 so as to lift the main lift carriage or face plate 100 and related features until either the first support bar or finger support bar 102 or the lift saddle 116 engages an appropriate lift pickup point of the corresponding refuse collection cart type, and thereafter automatically diverts hydraulic drive power from cylinder 172 to a hydraulically actuated rotary motor 166 so as to lift and dump the refuse collection cart engaged on the main lift carriage 100.

With collective reference to present FIGS. 4, 10, and 11, the following description explains in detail various clamp actuations means in accordance with the subject invention. Generally speaking, drive means 166 may comprise a hydraulically actuated rotary motor having a transverse output shaft 186 with respective ends thereof 188 and 190. A pair of torque arms 192 and 194 are received in fixed rotational relationship on opposing respective ends 188 and 190 of the drive means output shaft 186 for being rotated therewith. The opposite ends of torque arms 192 and 194 are pivotably (i.e., rotatably) mounted on the main lift carriage or face plate 100 at points 196 and 198 adjacent a base portion generally 200 of face plate 100. Bolts 202 (FIG. 4) represent a bearing 204 or similar pivot mounting in which the appropriate ends of torque arms 192 and 194 may be received.

A pair of idler arms 206 and 208 may also be pivotably supported at respective first ends thereof on the support frame generally 178 or the housing for drive means 166, and at respective second ends thereof on the main lift carriage or face plate 100. The attachment points generally 210 and 212 are respectively relatively displaced from the base portion 200 of face plate 100 and relatively displaced from attachment points 196 and 198 of torque arms 192 and 194. Attachment bolts and bearings may also be used at points 210 and 212. With such an arrangement, the main lift carriage is raised and inverted by the torque idler arms responsive to predetermined rotation of the drive means output shaft 186, as discussed in greater detail below with reference to present FIGS. 12A through 12E. The additional respective bends 214 formed in the idler arms advantageously permits additional leverage for further displacing the contents of a cart being emptied into a refuse collection vehicle or container box. Timing changes may also be made with such bends, as noted below.

Clamp actuation means in accordance with the subject invention are operative for closing the relatively movable upper clamping member 104 towards the relatively fixed lower clamping member 102 as the drive means 166 operates. Such functioning is achieved by providing at least one linkage 108 between such clamp arm 104 and one of the moving torque or idler arms 192, 194, 206, or 208. Since such torque or idler arms comprise interconnecting arms operatively interconnected between drive means 166 and lift plate 100 for imparting movement thereto, the clamp actuation means by such linkage 108 is functional in response to operation of such drive means 166. The length and/or connection positioning of such linkage 108 may be adjusted so as to correspondingly adjust or vary the timing of actuation of clamp 104 in relation to operation of the drive means 166. By such arrangement, both the full clamping movement of clamp 104 and the timing thereof may be adjusted so as to ensure adequate engagement of cart 50 on lift plate 100 without overcrushing the lip 52 thereof, which could result in damage to cart 50.

More preferably, the clamp actuation means linkage includes a pair of rods operatively interconnected with the movable upper clamping member 104 and at least two of the torque and/or idler arms. Present FIG. 11 illustrates interconnection of such exemplary arms 216 and 218 to torque arms 192 and 194, respectively, although it is to be understood that alternative interconnections such as with idler arms 206 and 208 could be practiced. It is to be further understood that clamp arm 104 is preferably pivotably mounted such as about a support shaft 220 and interconnected through a further pair of shortened linkages 222 to ensure the proper application of rotational force in relation to such shaft 220.

Figure 15:
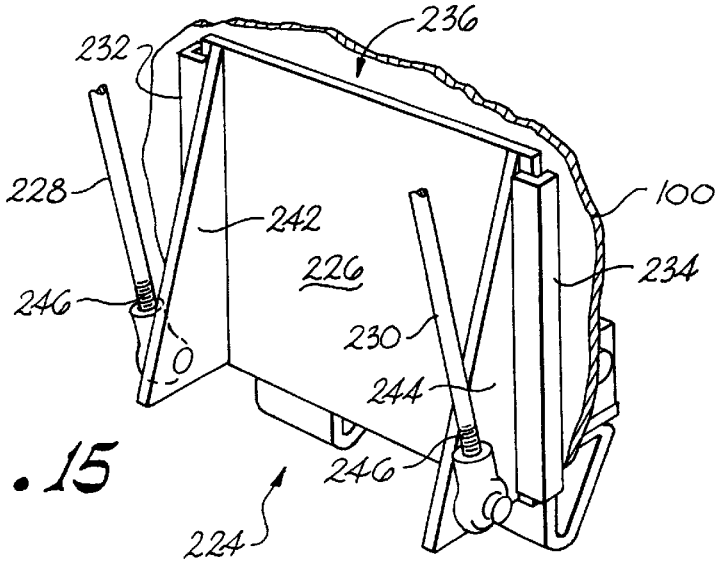
FIG. 15 is an isolated view of a portion of the exemplary embodiment of present FIGS. 4, 10, and 11 showing further features thereof in accordance with present sliding or extending latch aspects of the subject invention, such as further referenced in conjunction with present FIGS. 8A through 8D.

FIG. 15 represents an isolated view of a portion of the exemplary embodiment of lifter 20 of present FIGS. 4, 10, and 11, showing further features thereof in accordance with the present sliding or extending latch aspects of the subject invention, as described above in conjunction with present FIGS. 8A through 8D and the movement of lower latch member 110 in the direction of arrow 158. More particularly, the subject invention includes face plate extension means or a slide latch assembly generally 224 which is operative during operation of the drive means 166 for moving a face plate extension member 226 between respective retracted and extended positions thereof relative to lower edge or lower portion 200 of main face plate 100. Such retracted and extended positions are obtained in correspondence with respective lowered and raised positions of face plate 100.

The slider latch assembly receives thereon lift hook or lower latch member 110 and the above-described features corresponding therewith, such as the housing 126 therefor. With such an arrangement, the member 110 is extended relative base portion 200 of the face plate generally in the direction of arrow 158 of present FIG. 8C so that lower lift engagement feature 32 of cart 26 becomes latched by lower latch member 110. Carriage extension member actuation means are provided in essence by a pair of arm 228 and 230 which are actuation linkages extending between face plate extension member 226 and a relatively fixed position support (such as some portion of support frame 178) for drive means 166.

The face plate extension means further preferably includes two generally upright slide channels 232 and 234 (FIG. 15) received in generally lateral respective positions on a rearward side 236 of face plate 100. Face plate extension member 226 preferably comprises a generally planar member with respective lateral edges thereof received in sliding relationship respectively in such two slide channels 232 and 234, as shown in present FIG. 15. The actuation linkages 228 and 230 comprise a pair of rigid rods respectively pivotably attached adjacent to lateral bottom edges of face plate extension member 226 and to relatively fixed positions 238 and 240 of support for drive means 166. As shown, such rods are actually supported on triangular or other shaped extensions 242 and 244 and are further secured with threaded arrangements 246 to permit length adjustments of rods 228 and 230, with corresponding time adjustments for extension of member 226 (i.e., engagement of latching member 110).

Still further in accordance with an exemplary embodiment of the subject invention, roller means generally 248 may be carried on the face plate extension member 226 for rotatably engaging a lower portion of a receptacle or cart to be dumped as such cart is being raised. Such an arrangement results in stable lifting of the cart even with a relatively shortened face plate area whenever the main face plate 100 is lowered and the face plate extension member 226 is retracted. Another advantage specifically of the roller means is that it provides for overall smoother operations and less likelihood of scarring or damage to the adjacent side surface or face of a cart being emptied.

FIGS. 12A through 12E are progressive sequence illustrations of partial cross-sectional views of the present exemplary embodiment of present FIGS. 4 and 11, showing more particular lift and dump operations thereof, though without specific illustration of certain present optional vertical lift assembly features which have been described above in detail. Such sequential figures in particular show relative movements of the first support bar 102 and clamp bar assembly with clamp bar 104 in relation to lift plate 100 as it advances from its relatively lowered upright position to its relatively raised inverted position. Also shown are the changing interrelationships of the torque and idler arms in conjunction with the actuation rod 108 for relatively moving clamp bar 104 during such dumping cycle.

In similar fashion, the interrelationship of lower latch member 110 and upper latch member 116 are illustrated in relation to lift plate 100 as it moves between its two respective lowered and raised positions. Shown in conjunction therewith is the changing position and operation of face plate extension means actuation arm 228. Those of ordinary skill in the art will note the changing relative extension of face plate extension member 226 beyond (i.e., below) the base portion 200 of face plate 100 as the illustrations sequentially progress from present FIGS. 12A through 12E.

Figure 12A:
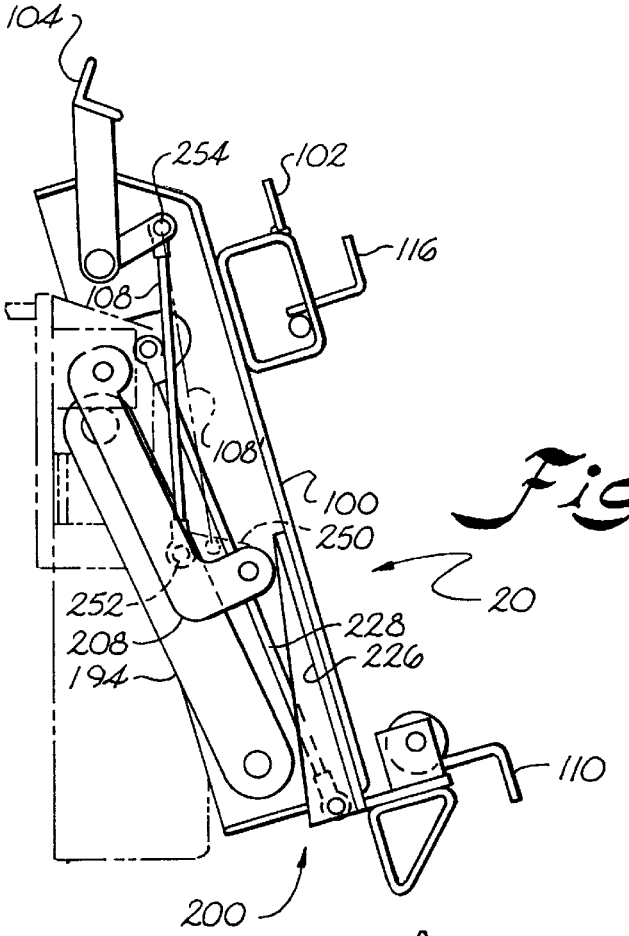
FIGS. 12A through 12E are progressive sequence illustrations of partial cross-sectional views of the present exemplary embodiment of present FIGS. 4 and 11 showing more particular lift and dump operations thereof, though without specific illustration of certain present optional vertical lift assembly features.
Figure 12B:
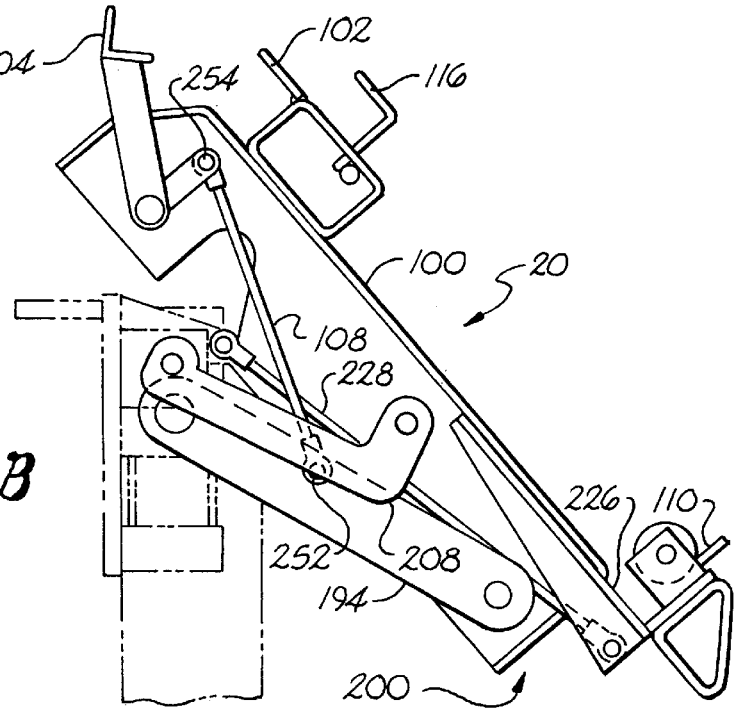
Figure 12C:
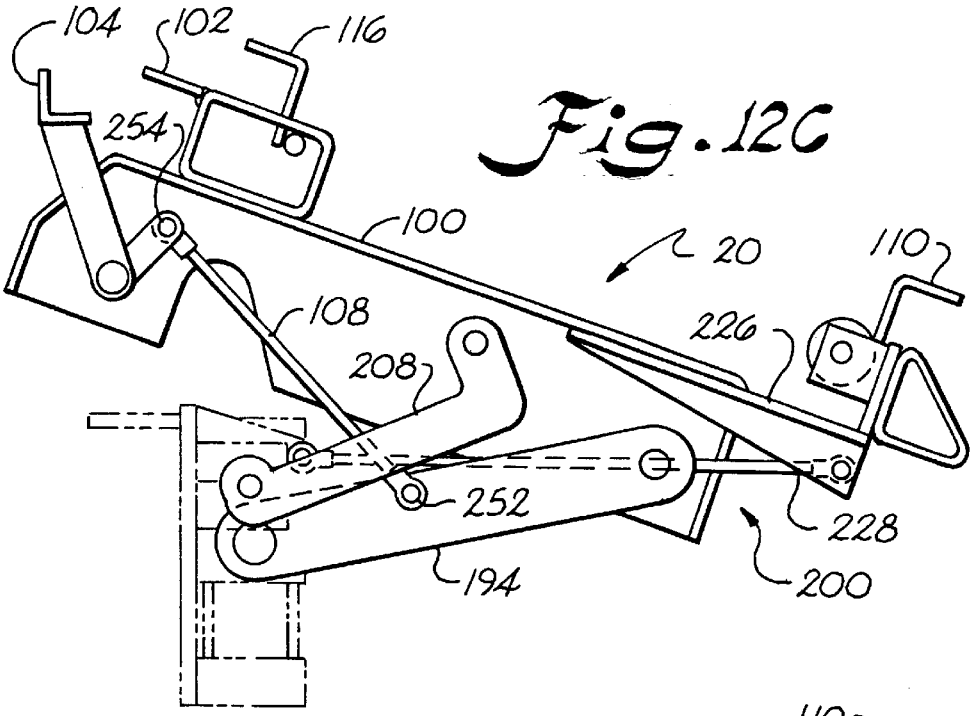
Figure 12D:
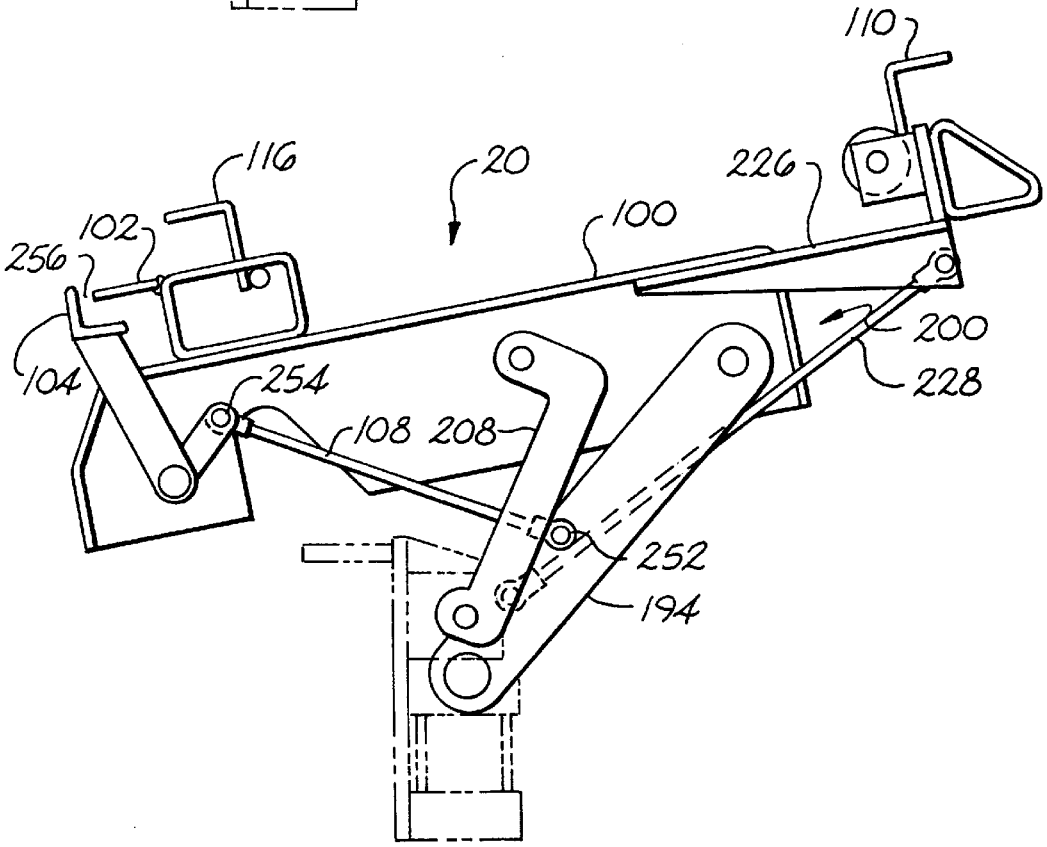

It should be further noted by those of ordinary skill in the art that present FIG. 12A illustrates an alternate attachment point for a dotted line illustration of actuation rod 108'. In such alternate arrangement, the actuation rod 108' is connected to a part of bent arm 208, specifically an illustrated (in dotted line) triangular shaped region 250 thereof. In relation to the solid line illustration of connection at point 252 on torque arm 194, clamp arm 104 is adjusted insofar as timing of closing in relation to operation of drive means 166. Those of ordinary skill in the art will understand and appreciate from the disclosure herewith that other changes in such timing or operation of closure of clamp arm 104 may be made by further adjustments to the length and/or positioning of the interconnection of actuation rod 108 in relation to its other connection point 254.

Figure 12E:
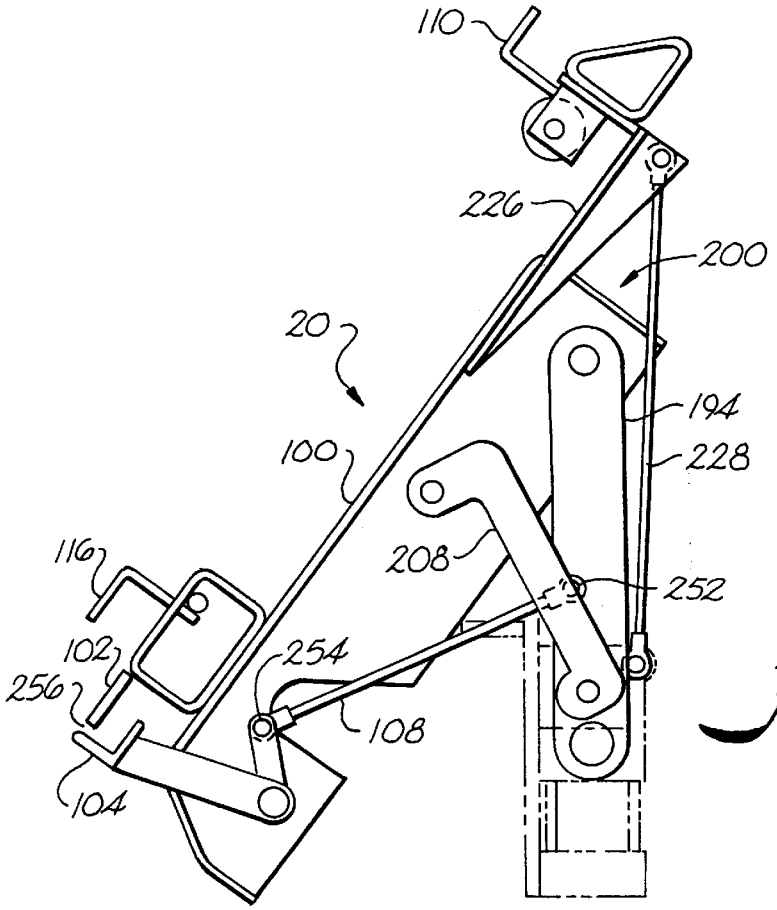

It will be further noted by those of ordinary skill in the art from the present illustrations that a gap generally 256 (FIG. 12E) remains between clamping elements 102 and 104 after face plate 100 is raised into its fully raised inverted position. Such an arrangement prevents overclamping or crushing of the lip 52 of a container 50, so as to prevent undesired damage thereto. At the same time, FIG. 12E represents that such gap 256 (which is adequate for clamping of the container 50) is actually achieved earlier in the dumping cycle so that container 50 is properly engaged (i.e., secured) to lift plate 100 in accordance with the subject invention.

Figure 13:
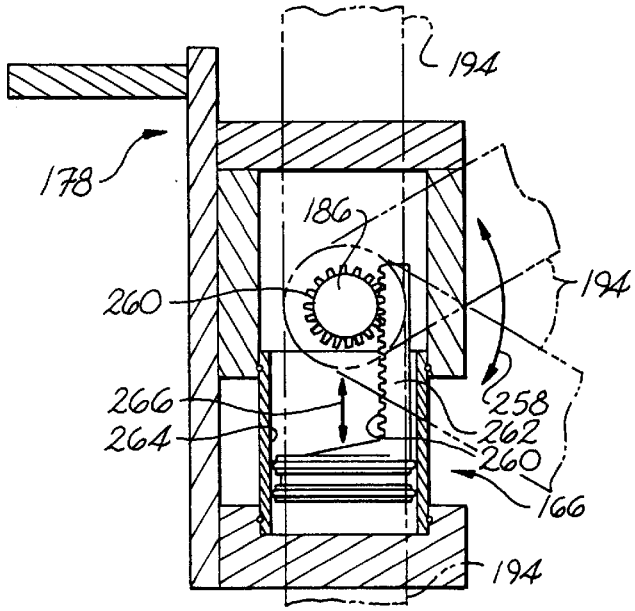
FIG. 13 is an enlarged partial cross-sectional view representative of certain present drive means features.

Present FIG. 13 is an enlarged partially cross-sectional view representative of certain present features of exemplary drive means 166. As illustrated, such drive means generally 166 are supported on a support frame generally 178 and rotatably power a torque arm 194 through different positions thereof as represented by dotted line illustrations 194 and double-headed arrow 258. See also the complete description and disclosure set forth in U.S. Pat. No. 4,773,812 (fully incorporated herein by reference).

Such exemplary drive means 166 may comprise a hydraulically actuated rotary motor, with an output shaft 186 thereof positioned substantially perpendicular to the plane of movement of carriage 100. Such rotary motor includes rack and pinion gear teeth 260 respectively supported on a reciprocal piston rod 262 and on a rotatable portion of the output shaft 186 passing through the rotary motor. Preferably, such rack and pinion gear teeth engage one another immersed in hydraulic fluid within a cylinder 264 of the rotary motor. As will be apparent to those of ordinary skill in the art, such piston rod 262 reciprocates along an axis in the direction of double-headed arrow 266 in response to the selected introduction of hydraulic fluid passing against the piston head or against the bottom thereof, which translates rotary motion of output shaft 186 into desired movement of face plate 100 (via torque arms 192 and 194). Other drive means may be practiced.

The following discussion relates to FIGS. 16A through 19, and outlines certain hydraulic drive circuit features in accordance with this invention. Hose interconnections such as "VA" and "VB" are shown in correspondence on several of the different drawings, as will be understood by those of ordinary skill in the art.

Figure 17:
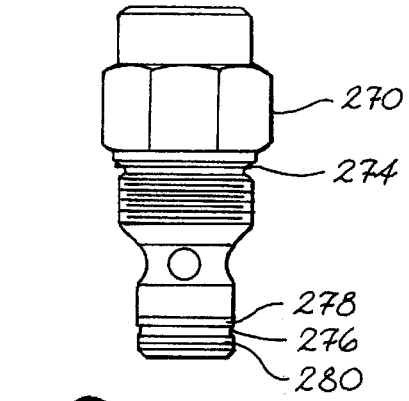
FIGS. 17 and 18 are respective views of two different exemplary adjustment features of the sequencing means in accordance with the exemplary embodiment of present FIGS. 16A and 16B.
Figure 16A:
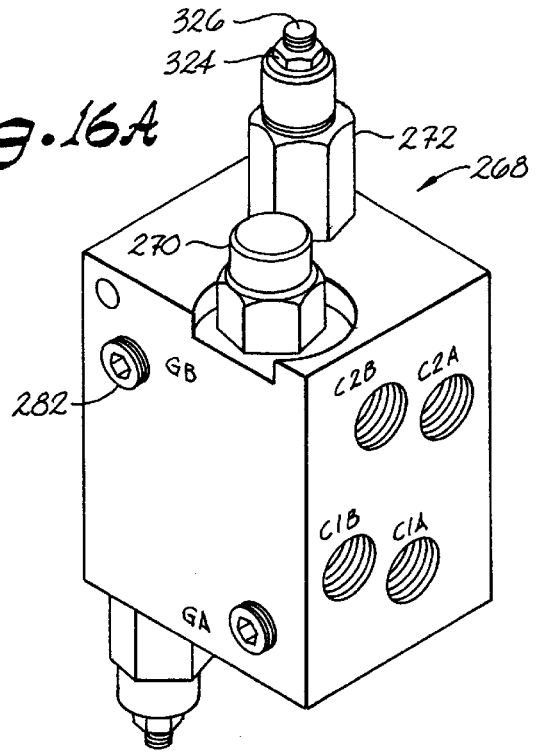
FIGS. 16A and 16B are respective generally side perspective views showing opposite sides of exemplary sequencing means or cycle control means in accordance with the subject invention.
Figure 18:
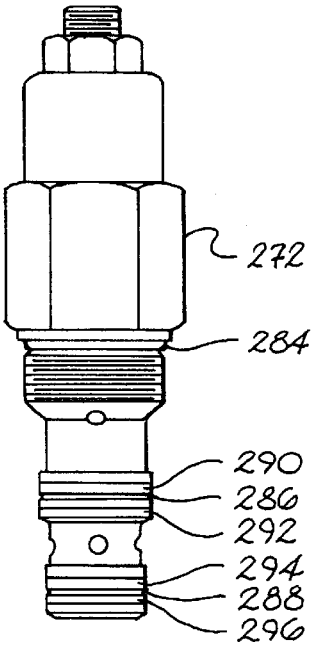
Figure 16B:
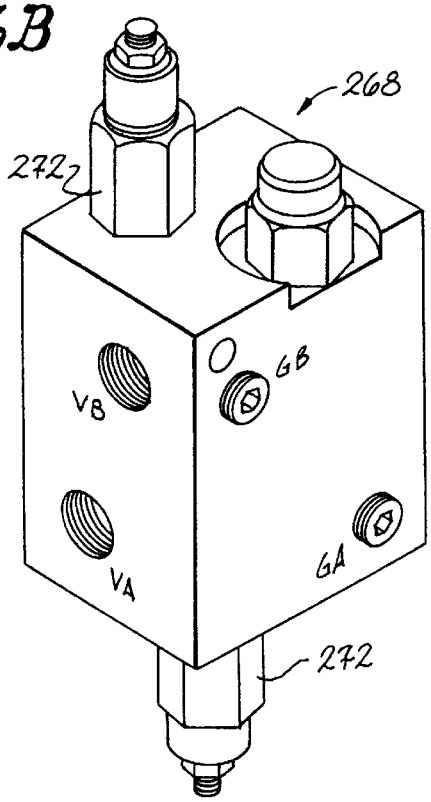
Figure 19:
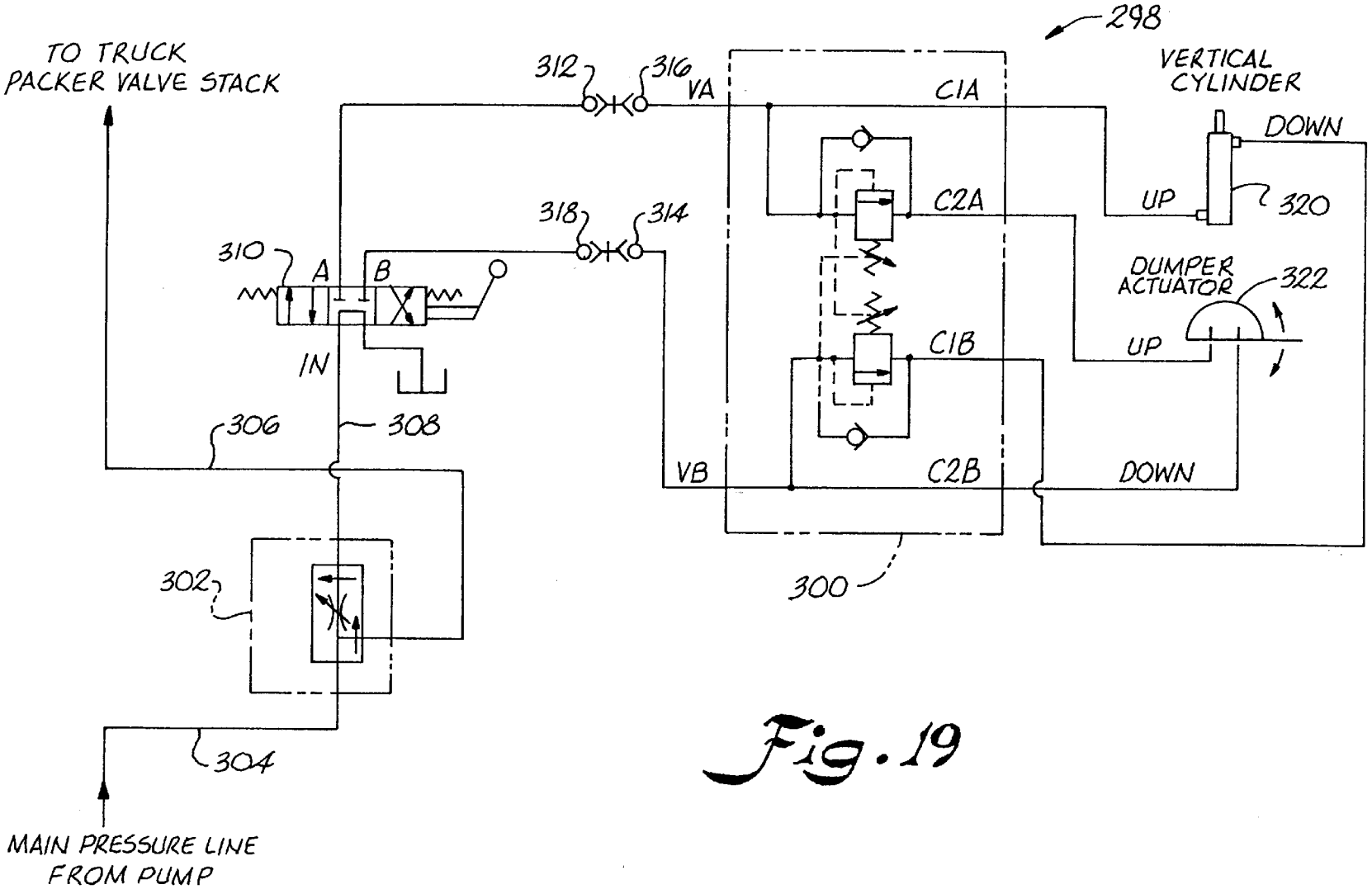
FIG. 19 is a schematic representation of an exemplary hydraulic circuit in accordance with the subject invention, including incorporation therein of present optional vertical lift assembly features.

Generally speaking, FIGS. 16A and 16B are respective generally side perspective views showing opposite sides of exemplary sequencing means 268 (dual sequencing valve) or cycle control means in accordance with the subject invention. FIGS. 17 and 18 are respective views of two different exemplary adjustment cartridges 270 and 272 for the sequencing means in accordance with the exemplary embodiment of present FIGS. 16A and 16B. FIG. 19 is an overall schematic representation of an exemplary hydraulic drive circuit in accordance with the subject invention, including incorporation therein of present optional vertical lift assembly features.

More specifically, the dual sequence valve generally 268 is of a construction as explained in greater detail hereinafter, and is an available component from Fluid Controls Incorporated of Easley, S.C.

Element 270 comprises a check valve cartridge which is outfitted with an O-ring seal 274, and a further O-ring seal 276 which is adjacent to a pair of back-up washers 278 and 280.

Element 282 associated with sequencing means 268 is a form of an exemplary pipe plug for inputs not otherwise utilized with hydraulic lines as discussed hereinafter.

Element 272 comprises a sequence valve cartridge which also includes O-ring seals 284, 286, and 288. The relatively lower O-ring seals include back-up washers 290, 292, 294, and 296.

Referring now to present FIG. 19, a complete schematic representation of a hydraulic drive circuit generally 298 is illustrated. The dotted line enclosure 300 generally equates to the dual sequence valve 268, noted above. The dotted line enclosure 302 is representative of a complete diverter valve, which is well understood to those of ordinary skill in the art. As illustrated, such diverter valve is arranged for receiving main pressurized hydraulic fluid through a main pressure line 304 from a hydraulic pump or similar source. When appropriately set, diverter valve 302 can cause the pressurized hydraulic fluid to be directed to the packer valve stack of an associated refuse collection truck via hydraulic line 306. In other words, such hydraulic arrangements would be utilized during the dumping of container box 46 of present FIGS. 2A and 3.

On the other hand, diverter valve 302 may be used to direct hydraulic fluid along another hydraulic line 308 whenever it is desired to empty the contents of a cart utilizing the present lifter 20. Schematic element 310 represents the hand valve such as discussed above in conjunction with valve 88 of present FIG. 3. The schematic representations should be fully understandable to those of ordinary skill in the art, without additional detailed description thereof.

Elements 312 and 314 represent quick coupler-female coupler elements while features 316 and 318 represent quick coupler-male nipple coupling elements, as discussed above for example for rapid disconnect of a container box 46 in accordance with the subject invention from refuse collection vehicle 42.

The schematic representation generally 320 of a vertical cylinder corresponds with the vertical hydraulic lifting cylinder 172 discussed above such as in conjunction with present FIGS. 4, 10, and 14.

The schematic representation of a dumper actuator generally 322 corresponds with a drive means 166 as generally discussed above with reference to various present figures, including for example present FIGS. 10, 11, 13, and 14.

It will be understood by those of ordinary skill in the art from the present disclosure herewith that the present sequencing valve arrangement allows the vertical cylinder 320 to fully extend and raise a cart before dumping thereof. The sequence valve arrangement also permits the full recovery of the dump cycle (i.e., operation of dumper actuator 322) before the vertical cylinder 320 is retracted for lowering the cart.

It is to be understood that valve and line connection points are made via conventional hydraulic lines between correspondingly indicated reference characters. The following discussion includes reference to such reference characters.

Generally speaking, hydraulic fluid or oil flowing into port VB flows directly through the dual sequencing valve 268 and out port C2B thereof. When pressure on port C2B reaches a certain level, such as approximately 1,000 to 1,500 PSI, the sequencing valve cartridge 272 shifts so as to direct the flow of hydraulic fluid out port C1B. The return of hydraulic fluid from the lifter circuit (i.e., dumper actuator 322) flows through port VA and back to the hydraulic tank.

Hydraulic fluid flowing into port VA flows directly through the dual sequencing valve 268 and out port C1A. When the pressure on such port C1A reaches a predetermined number such as approximately 1,000 to 1,500 PSI, the sequence valve cartridge 270 shifts so as to direct the hydraulic fluid flow out port C2A. The return of hydraulic fluid from the lifter circuit (i.e., from dumper actuator 322) flows through port VB and back to the hydraulic tank.

Operation of the sequence valve cartridge 270 determines or dictates the pressure required at port C1A before the flow of hydraulic fluid is diverted to port C2A. The function of sequence valve cartridge 272 dictates or determines the hydraulic fluid pressure required at port C2B before diversion of the hydraulic fluid flow to port C1B.

Whenever pressurized, port VA functions to permit hydraulic fluid in for vertical extension and actuation of the dumper or lifter. Port VB when pressurized functions so as to permit an inward flow of hydraulic fluid for reversal of the actuator and retraction of vertical lift features. Port C1A when pressurized is functional with respect to vertical extension features, while port C1B is oppositely involved with vertical retraction operations. Ports C2A and C2B are respectively functional when pressurized for actuator (i.e., drive means) dumping and reversing operations, respectively.

As illustrated, both sequence valve cartridges 270 and 272 are preferably fitted with hexagonal drives or similar exterior features for adjustment thereof. In order to adjust sequence pressure, first a lock nut portion 324 of the top of cartridge 272 should be loosened. Thereafter, the central adjusting screw 326 therein should be turned in a clockwise direction when desired to increase the sequence pressure or in a counterclockwise direction in order to decrease the sequence pressure. Once properly positioned, the adjusting screw jam nut 324 is retightened. Ports GA and GB are to be used for hydraulic gauge ports respectively for ports VA and VB, as understood by those of ordinary skill in the art.

It will be further understood by those of ordinary skill in the art of hydraulic drive systems that the initial installation requires appropriate pressure settings so that in effect the dual sequence valve sends pressure to a second or subsequent cylinder or other hydraulic actuator whenever the first cylinder has fully functioned. In other words, the pressure actuation means should be determined and adjusted so that hydraulic drive fluid is directed to dumper actuator 322 after cylinder 320 has bottomed out or completed a full movement in a selected direction thereof. By such an arrangement, cycle control means are provided for first automatically engaging a cart with an engagement member in accordance with the subject invention, and thereafter automatically operating the drive means so as to lift and dump the contents of such engaged cart. As understood by those of ordinary skill in the art, the entire operation is thereafter reversed, for first returning the cart to its upright position and then disengaging therefrom.

With the foregoing features, a totally universal cart lifting apparatus or receptacle dumping apparatus may be provided which automatically matches and mates to the height of the cart to be dumped while also automatically matching and mating to the style of cart to be emptied.

Figure 20:
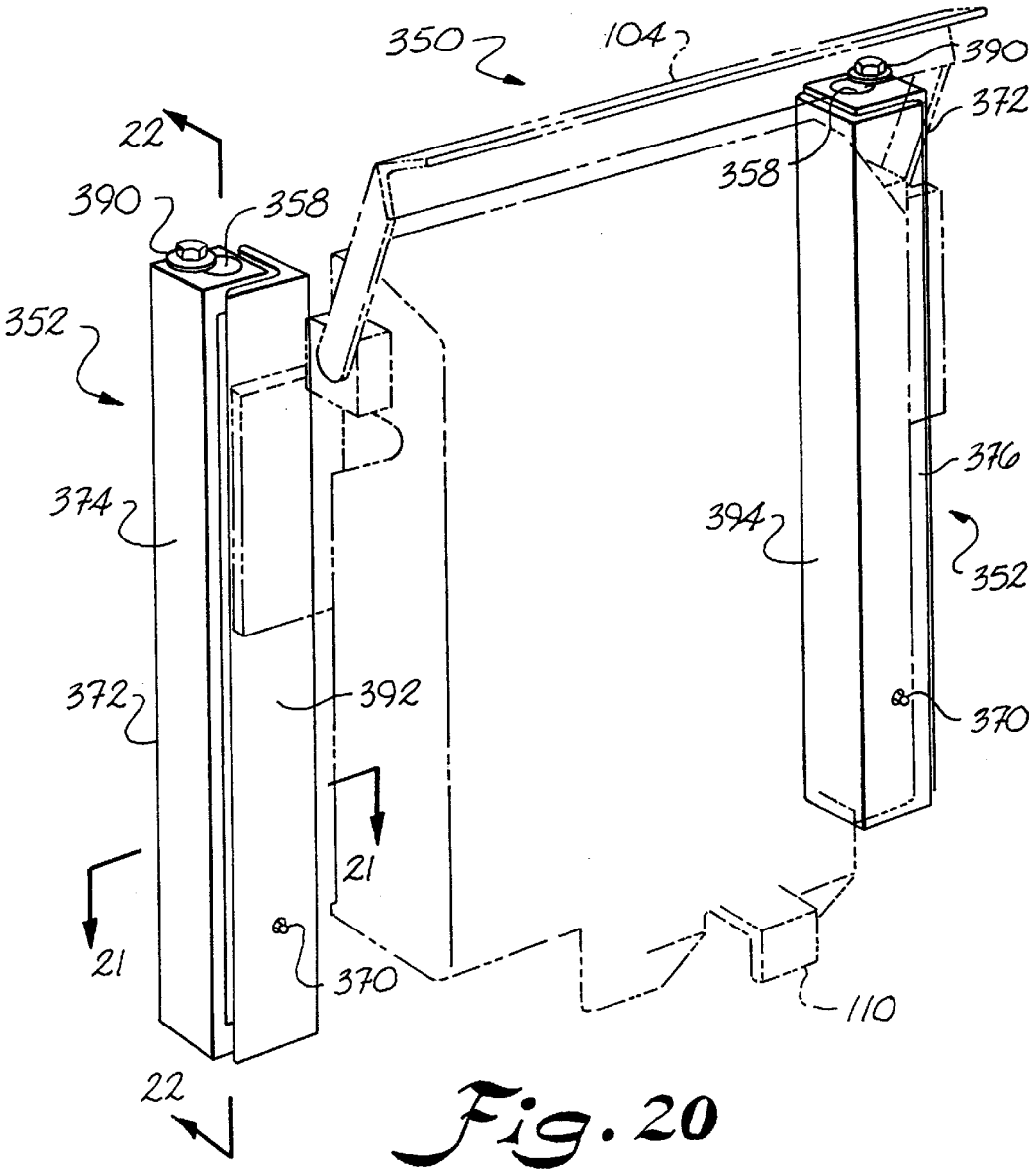
FIG. 20 is a generally front perspective view of another exemplary present embodiment, particularly representing certain vertical adjustment means features in accordance with the subject invention.

FIG. 20 is a generally front elevational view of a further embodiment 350 in accordance with the subject invention, particularly illustrating certain present vertical adjustment features. Certain features in common with prior embodiments, such as members 104 and 110 of present FIG. 4, are illustrated in dotted line, and complete details thereof need not be repeated here for a complete understanding of the embodiment 350. Particular features of the vertical adjustment means generally 352 in accordance with the present embodiment 350 are illustrated primarily in solid line. Such features generally take the place of the specific support frame member 178 of present FIG. 4, as well as the pair of lateral vertical guides 162 thereof, and the roller elements 184 which facilitate interaction between such members. Horizontal crossing support members, such as members 168 and 170, or the like, of present FIGS. 4 and 10, may however be practiced with the embodiment 350 (though for the sake of clarity they are not illustrated in present FIG. 20).

Figure 21:
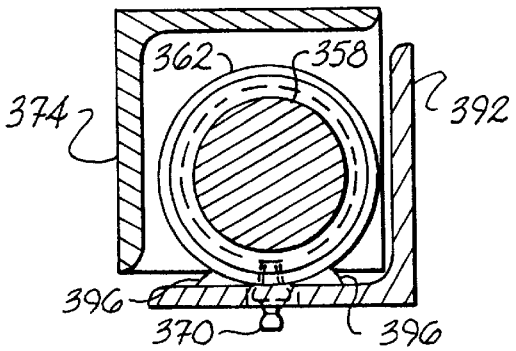
FIG. 21 is an enlarged partial generally transverse cross-sectional view of portions of the embodiment of present FIG. 20, taken along sectional line 21—21 therein.
Figure 22:
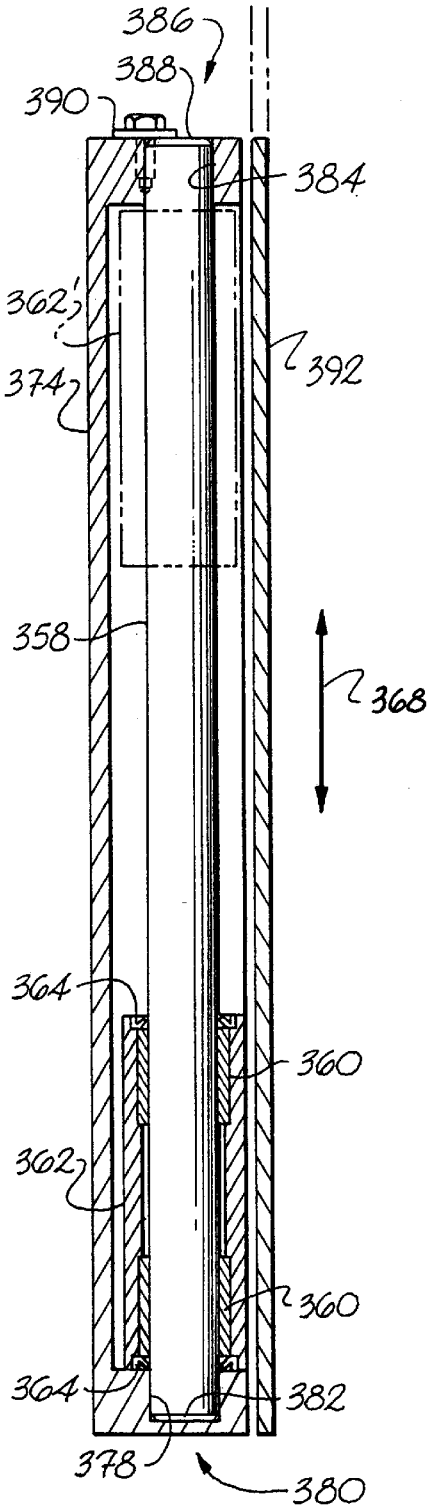
FIG. 22 is an enlarged partial generally longitudinal cross-sectional view of portions of the embodiment of present FIG. 20, taken along sectional line 22—22 therein.
Figure 23:
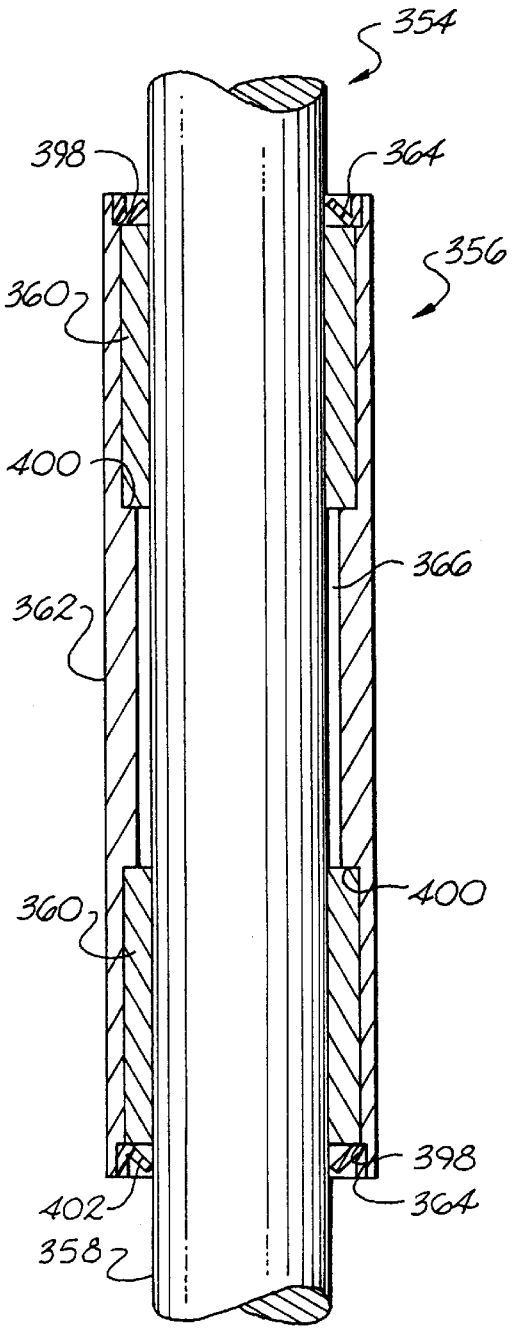
FIG. 23 is a further enlarged partial cross-sectional view of a portion of features of present FIG. 22, particularly concerning slip fit bushing features thereof.

Present FIG. 21 represents a generally transverse partial cross-sectional view (enlarged) of a portion of the embodiment of FIG. 20, taken along the sectional line 21—21 therein. At the same time, present FIG. 22 represents a generally longitudinal partial cross-sectional view (enlarged) of a portion of the FIG. 20 embodiment, taken along sectional line 22—22 illustrated therein. FIG. 23 represents a further enlarged view (cross-sectional) of a portion of the representation of present FIG. 22, as discussed in greater detail hereinafter. For the sake of convenience, all such FIGS. 20–23 are hereafter variously discussed collectively, and primarily by numerical reference characters.

Vertical adjustment means generally 352 are functional for relatively vertically shifting the position of a lift plate, drive means, and cart engagement means (such as members 104 and 110), between an initial null position thereof and a variable raised engaging position thereof at which the cart engagement means are positioned for engaging at least one predetermined lift engagement member on a cart to be emptied. In the exemplary embodiment of present FIGS. 20–23, such vertical adjustment means preferably includes at least one vertical guide member generally 354 with a slip fit bushing generally 356 movably associated therewith.

More specifically, the vertical adjustment means may include a pair of laterally spaced vertical guide rods 358 or other equivalent members. Each rod includes a respective pair of slip fit bushings 360 received on the rod. Further, each of the pair of bushings is enclosed by a bushing tube 362 with grease seal means 364 on opposite ends of the tube so as to form a greased annular cavity 366 between the bushings of a respective pair thereof, and between the outside diameter of rod 350 and the inside diameter of tube 362. With such an arrangement, the pair of bushings 360 are arranged for slip fit vertical travel thereof (see double-headed arrow 368 of present FIG. 22) along their respective associated vertical guide rod 358.

A grease fitting 370 is formed in and through each of the tubes 362 and interconnects between the exterior of such device and the respective greased annular cavities 366 thereof for periodic applications of grease to such cavities 366. Those of ordinary skill in the art are familiar with grease fittings, nipples, and the like without disclosure of additional details, which further details form no particular aspect of the subject invention.

In the embodiment of present FIG. 4, the vertical adjustment means 154 include a pair of lateral vertical guides 162 adapted to be attached (either through bolts, weldments, or the like) to a garbage truck, or possibly to other locations (such as a loading dock or the like) to which the lifting apparatus is to be mounted. In the embodiment of present FIG. 20, vertical support means generally 372 are likewise provided for attachement (i.e., being bolted, welded, or the like) to a garbage truck, loading dock, floor stand, or other similar main support structure.

As illustrated, the function of such vertical support means is to further support the vertical guide rods 358. While such vertical support means may comprise various embodiments, one preferred embodiment which may be readily fabricated for the sake of simplicity, while providing adequate strength and durability, involves use of a first pair of elongated right angle members 374 and 376. A blind seating bore 378 may be formed at the bottom end generally 380 of each right angle member for receiving a corresponding end 382 of rod 358. An upper through bore 384 is formed in each upper end generally 386 of the right angle members for receiving the upper end 388 of rod 358 therein. As further illustrated, particularly in present FIGS. 20 and 22, bolt means 390 or the like may be threadably received in an appropriate opening in end 386 so as to selectively secure rods 358 within member 374 or 376.

As further represented in the figures, a second pair of elongated right angle members 392 and 394 (or some other construction) may be provided to serve as movable support elements respectively attached to the bushing tubes 362. Such attachment may take the form of welding as shown by weldments 396 or other suitable arrangements providing adequate connecting strength. The strength of the connection is significant since there is corresponding support of the lift plate, drive means, and cart engagement means of the embodiment 350, such as with the use of further cross-connecting members (for example members 168 and 170 of present FIGS. 4 and 10; not shown in present FIG. 20). With the foregoing arrangement, selected vertical movement of the supported members (in the direction of double-headed arrow 368) may be readily accomplished relative to the vertical support means 372.

As further represented in the subject figures, the first and second pairs of right angle members are preferably mutually situated so as to form a pair of four-sided arrangements with one of the rods 358 and bushing tubes 362 respectively received within each of such arrangements. While alternative embodiments may be practiced in accordance with the broader aspects of the subject invention, the illustrated exemplary embodiment provides considerable stability, especially in the lateral sense, during dynamic (i.e., vertical movement) lifting operations. In addition, the improved stability extends for substantially the full range of motion represented by present FIG. 22, including the alternate positions of the solid line representation of bushing tube 362 and the dotted line representation 362' thereof.

As more particularly shown in the further enlarged illustration of present FIG. 23, grease seal means 364 may comprise an O-ring or other type seal received in annular shoulders 398 formed or defined in respective ends of the respective bushing tubes 362. The bushing tubes further define internal annular shoulders 400 therein for receipt of the respectively associated pairs of slip fit bushings 360. Friction or compression fits or the like may be practiced, as well as other methods of reasonably seating the described structures. Those of ordinary skill in the art will appreciate that the exemplary grease seal means may comprise a flexible lip element 402, or other (numerous) variations thereof. In other words, the term "O-ring" for purposes of this application means any type of grease sealing ring, such as a V-ring, or single or multiple lip device, or even a baffle seal or other equivalent device.

Those of ordinary skill in the art will appreciate from the foregoing description that one, two, or more of the vertical guide members and slip fit bushing arrangements may be practiced with a given device. Moreover, it will be appreciated that vertical guide members and corresponding slip fit bushings of shapes other than annular may be practiced. Annular configurations have been primarily illustrated at present due to ease of manufacturing and availability. However, rectangular, square, triangular, or other mating shapes (cross-sectional views) may be practiced for such vertical guide member and slip fit bushing features. Likewise, it should be understood and appreciated that other methods of sealing a slip fit bushing arrangement may be practiced, or that intended permanently sealed greasing (i.e., lubricating) arrangements may be practiced in lieu of the grease fitting arrangement as illustrated. In addition, alternative grease fitting arrangements and/or grease nipple placement positions may be practiced.

Those of ordinary skill in the art will further understand from the totality of the foregoing description the other features which may be practiced in conjunction with lifting apparatus embodiment 350. For example, cycle control means as described above in conjunction with the embodiment of present FIG. 4, may be practiced in conjunction with the vertical adjustment means and drive means for first variably operating the vertical adjustment means so as to engage cart engagement means with at least one lift engagement member of a given cart to be emptied, the height of which engagement member is not specifically known, and for thereafter automatically operating such drive means so as to lift and dump the contents of the engaged cart.

Likewise, alternative cart clamping means and cart engagement means as well as cart latching means, all as variously described above in different embodiments, may be practiced in conjunction with the above-described vertical guide member and slip fit bushing features. The same is true for present lift plate extension means, roller means, drive means, and other present features. By way of further example, the cycle control means may include a hydraulic drive circuit for actuating a hydraulic rotary motor as well as a hydraulic lifting cylinder. A dual sequencing valve may be provided for first applying hydraulic drive power to the hydraulic lifting cylinders so as to lift the drive means and the lift plate until the cart engagement means engages a cart to be lifted. Thereafter, the cycle control means may automatically divert hydraulic drive power from the hydraulic lifting cylinder to the hydraulically actuated rotary motor so as to lift and dump the refuse collection cart engaged on the lift plate.

Those of ordinary skill in the art will further appreciate that the exemplary embodiment 350 may be practiced in conjunction (i.e., combination) with still further features disclosed herewith. For example, the embodiment 350 may include drive dampening means for selectively slowing controlled movement of the lift plate during a predetermined portion of a cart dumping cycle. More specifically, in those instances whenever drive means for the lifting apparatus include a hydraulically actuated piston in a cylinder, the drive dampening means may include means for selectively limiting the flow of hydraulic fluid within the drive means cylinder in response to the relative position of the piston therein. Greater details of an exemplary such embodiment are discussed below in conjunction with the description of present FIGS. 24–26.

Present FIGS. 8A through 8D illustrate operation of certain vertical lift assembly features in accordance with the subject invention, including vertical adjustment means 154 (such as described above in conjunction either with present FIG. 4 or as discussed in conjunction with present FIGS. 20–23). In progressive sequence, FIGS. 8A through 8D represent in essence one half of a complete dumping cycle, during which a cart 26 at rest on the ground or other support surface 156 is initially engaged and picked up, and thereafter raised (FIG. 8C) and then inverted (FIG. 8D) so as to dump the contents thereof into a larger garbage receptacle or other desired location. In degressive sequence of FIGS. 8D through 8A, the latter half of a full dumping cycle is shown, during which the emptied cart is returned to the ground.

Particularly in conjunction with assuming the position shown in FIG. 8D, there is a tremendous amount of potential movement, vibration, and strain due to the sheer bulk of the weight being handled and the distance it is being moved. Another factor is that the weight being lifted and dumped (as much as 200 pounds) fairly suddenly comes to a halt as it assumes the position of FIG. 8D. Such fact, taken with the fact that much of the weight is beginning to fall away from the arrangement (due to dumping of the cart contents), means that significant strains and the like may be placed on both the cart and the lifting apparatus. Those of ordinary skill in the art will appreciate that long term maintenance of a cart can involve addressing the accumulated damage which occurs to a cart, such as to the lift bars 30 and 32 thereof (see FIGS. 8A through 8D), or to the single lift lip 52 thereof (see FIGS. 9A through 9D) depending on the cart style. Features illustrated in present FIGS. 24 through 26 help serve to limit or minimize the strain and stress applied to both the cart and the lifting apparatus, as described in greater detail hereinafter.

It should be further understood from the following discussion of drive dampening means of this invention that the cushioning or dampening advantages thereof may be applied to piston/cylinder arrangements utilized in devices other than lifting apparatuses.

It should be further understood that the following aspects of the present invention may be adapted for cushioning various phases of the piston operation, but are particularly desirable (for purposes of a lifting apparatus) for dampening the speed of operation as the piston completes its travel towards one end of the cylinder (i.e., as the cart 26 fully assumes the illustrated position of FIG. 8D). By cushioning operation of the mechanism at such point in the dumping cycle, stress and strain on both the cart (including pick-up bars 30 and 32 thereof) and the lifting apparatus is minimized. At the same time, overall operational time is minimized by automatically returning to a "full" or higher speed during other phases of the dumping cycle.

Present FIG. 13 illustrates in detail a drive means in accordance with the subject invention, including a piston-driven rack 262 movable in the direction of double-headed arrow 266 within a cylinder 264. The rack 262 turns pinion gear 186 for driving the overall lift mechanism. The lower end of cylinder 264 is captured within an end cap, body member, or similar device (not marked with a reference character). The illustration of FIG. 13 represents a single such end cap or body member capturing two separate cylinders 264. It is to be understood that one, two, or more such cylinders (with corresponding respective pistons) may be practiced in accordance with the subject invention as hereinafter described. Commonly assigned U.S. Pat. No. 4,773,812, issued Sep. 27, 1988, provides additional details of an exemplary drive means. In particular, lower housing member 138 as shown in FIG. 5 of such '812 patent may be replaced with features as described hereinbelow. See also Reexamination Certificate B1 4,773,812, issued Apr. 16, 1991. The disclosures of both such documents are fully incorporated herein by reference.

Figure 24:
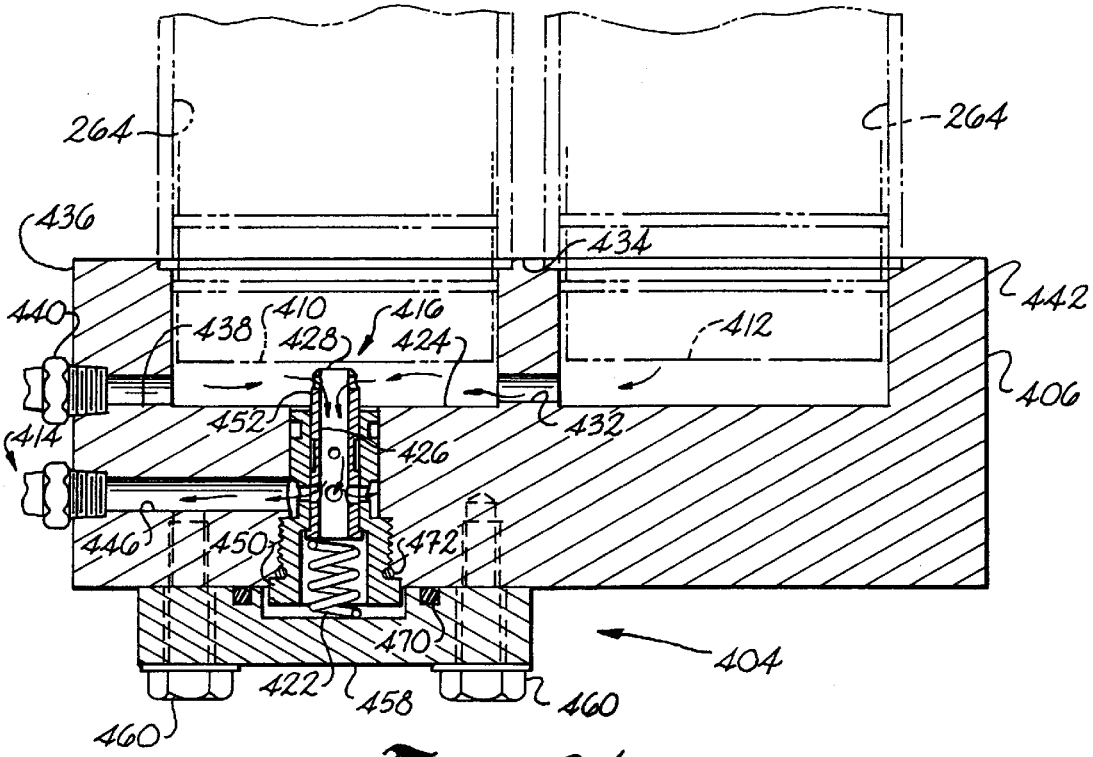
FIG. 24 is an enlarged partial cross-sectional view representative of certain present drive means features, including certain drive dampening means aspects thereof.

FIG. 24 represents an enlarged partial cross-sectional view showing certain present drive means features, including certain drive dampening means aspects generally 404. As discussed, a lower end cap, lower housing, or other similar element may be replaced from other similar drives with a specialized end cap 406 and additional features utilized in conjunction therewith, as described hereinafter. With such an arrangement, drive dampening means generally 404 are provided for selectively slowing the controlled movement of the lift plate (with cart thereon) during a predetermined portion of a cart dumping cycle, so as to reduce strain on the cart during final dumping thereof. As referenced above in conjunction with FIG. 8D (and FIG. 9D), the preferred predetermined cart dumping cycle portion relates to the point in time during full raising and inversion of the cart for dumping thereof.

Figure 25:
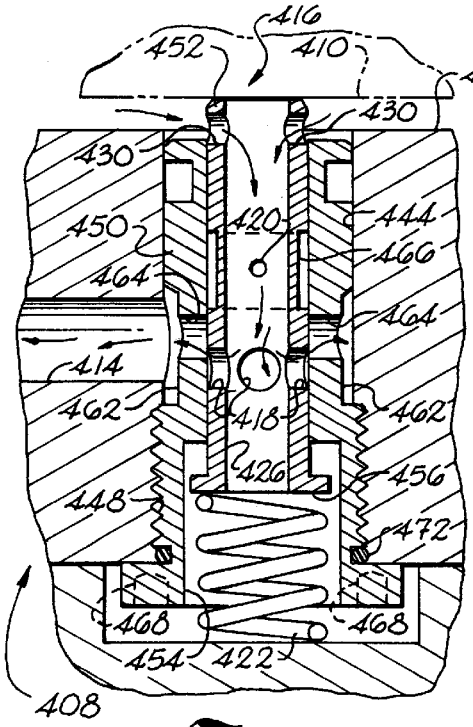
FIGS. 25 and 26 are further enlarged partial cross-sectional views of certain present aspects of drive dampening means features of present FIG. 24, more particularly illustrating representative first and second positions of a movable actuation member thereof.
Figure 26:
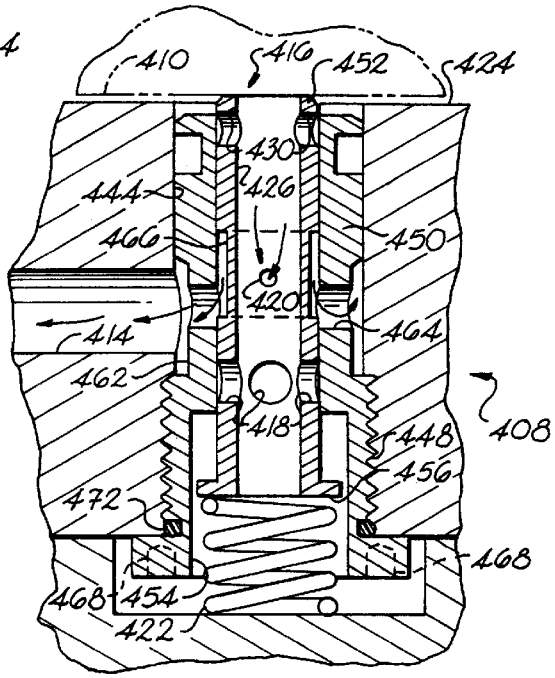

More specifically, the drive dampening means includes means (generally 408; i.e., present FIGS. 25 and 26) for selectively limiting the flow of fluid (generally hydraulic oil) within the drive means cylinder 264 in response to the relative position of a piston 410 therein. In particular, the means 408 interfaces with (i.e., engages with) the lower end of piston 410. FIGS. 25 and 26 respectively illustrate first and second positions of a movable actuation member, as described below. Present FIG. 24 represents an example of two cylinders wherein each cylinder has a respective piston, but (preferably) only one of the pistons is utilized for actuation of the subject invention. While the other piston generally 412 could be incorporated into operation of the drive dampening means aspects of the subject invention, generally such is not necessary.

Whenever used with a drive means including a hydraulicly actuated piston in a cylinder, the drive dampening means include means for selectively limiting the flow of the hydraulic fluid. Whenever used with a pneumatic (i.e., air driven system), the drive dampening means would be operative for selectively limiting the flow of the air through the pneumatic cylinder. Due to the nature of fluid flow mechanics (whether dealing with hydraulic or pneumatic systems), the fluid flow would be limited in both directions of travel within the cylinder. Hence, during restricted flow, operation of the piston within the cylinder (and therefore, operation of a correspondingly driven device) would be relatively changed (for example, slowed) regardless of the direction of travel of the piston (i.e., the fluid flow).

The following more detailed discussion specifies a hydraulic system since the illustrated example deals with the hydraulic drive means for a lifting apparatus, but those of ordinary skill in the art will appreciate that the principles disclosed herewith are equally applicable to pneumatic or other fluid flow systems.

The drive dampening means 408 may include a hydraulic oil port generally 414 which has a first predetermined diameter. In relatively simplistic perspective, drive dampening means 408 further may be viewed as having a movable insert generally 416 with at least first and second openings generally 418 and 420 which have different size bores or openings. A spring generally 422 is provided for biasing the movable insert generally 416 into the cylinder 264 so as to be contacted therein by piston 410 as such piston nears the end generally 424 of cylinder 264. As a practical matter, the true end of cylinder 264 may be defined in essence by the internal surface 424 of specialized end cap 406. In different embodiments, an actual cylinder 264 may comprise a sleeve which fits into end cap 406 to different predetermined depths.

In the foregoing overall embodiment, the movable insert generally 416 is moved from generally first position thereof as shown by FIG. 25 to a second position thereof generally as shown by FIG. 26. By such movement, the openings 418 are displaced from alignment with hydraulic oil port 414 so as to permit alignment of the second opening(s) 420 therewith. As represented, the bore of opening 420 is relatively smaller than that of openings 418, wherefore the fluid flow through drive dampening means 408 becomes relatively restricted.

Numerous fluid flow arrows in FIGS. 24–26 represent the generally hollow central passageway 426 provided in movable insert 416. Also represented is the fact that an open end tip 428 provides an initial flow passageway (FIG. 24) before becoming sealed (or at least substantially blocked) by contact with the bottom of piston 410 (FIGS. 25 and 26). However, one or more additional openings 430 formed adjacent to (but displaced from) such tip 428 permit continued flow of hydraulic (or pneumatic) fluid into the hollow central passageway 426. See in particular FIG. 25. However, as further represented by present FIG. 26, eventually such openings 430 will also become blocked from further fluid flow therethrough due to compression of spring 422 and expulsion of movable insert 416 generally from cylinder 264. Those of ordinary skill in the art will appreciate that variations may be made to the size and placement of such bores 430 so as to correspondingly vary the operation of piston 410 within cylinder 264 by varying the occurrence of fluid flow blockage.

In general, piston 412 will behave similarly to the behavior of piston 410 in view of the cross bore hole 432 formed in central wall 434 of end cap 406. While end cap 406 may be variously fabricated, one convenient way of creating cross bore hole 432 is to bore through the cylinder 264 for piston 410 from an outside wall 436, thereby additionally creating bore 438, which may be readily sealed with threaded member 440 or similar. In other words, there is no presently intended use for passage 438 and threaded sealing member 440 during operations of lifting unit. Likewise, it will be appreciated by those of ordinary skill in the art that such additional bore and closure therefor will not be required in embodiments utilizing but a single cylinder and piston. At the same time, a similar arrangement or its equivalent could be provided on the opposite side of piston 412 so as to penetrate wall 442 of end cap 406, or to connect yet a third (or more) cylinder on the far side of piston 412.

With the foregoing arrangement, the relatively smaller bore opening(s) 420 is selectively presented to the port 414 so as to dampen the flow of hydraulic oil operating the drive means near the end of the stoke of piston 410. In turn, the strain on the lifting apparatus and the cart during final cart dumping (represented by present FIGS. 8D and 9D) is lessened by softening (i.e., dampening) the overall lifter action.

The following description deals in greater detail with the present illustrations of FIGS. 25 and 26 in particular, showing additional functional details of the exemplary embodiment of drive dampening means aspects 408.

In another sense, the hydraulic oil port 414 in combination with the overall structure of end cap 406 may be regarded as comprising fluid port means associated with one end (generally 424) of cylinder 264 for conducting fluid in alternate directions in such cylinder for driven movement of piston 410 therein. In such sense, the particular drive dampening means aspects 408 may be regarded as comprising fluid flow rate regulating means received within the overall fluid port means and operative for establishing one of at least two different fluid flow rates for fluid conducted therethrough so as to drive the piston accordingly (under given load conditions) at two different corresponding speeds within the cylinder. Such regulating means may then be perceived as including a movable actuation member 416, movement of which between respective first and second positions (FIGS. 25 and 26 respectively) correspondingly selects two different fluid flow rates and hence, two different drive operational speeds.

With the foregoing arrangement, the spring 422 may comprise biasing means for biasing movable actuation member 416 into the first position thereof (FIG. 25) protruding into cylinder 264 and in the travel path of the piston 410 movably received therein so as to select a corresponding first fluid flow rate (via bores 418) through operation of the regulating means. Such biasing means 422 further permits (through its resiliency) the movable actuation member 416 to be moved into the second position thereof (FIG. 26) in response to engagement with piston 410 so as to select a corresponding second fluid flow rate (via bore(s) 420) through operation of the regulating means. As shown in FIGS. 24 and 25, the movable actuation member 416 projects into cylinder 264 a relatively small distance in its first position so that piston engagement occurs as such piston 410 nears the end 424 of cylinder 264. Also, the second fluid flow rate established with bore(s) 420 is preferably less than that of the first fluid flow rate established with larger bores 418, so that the movement speed of piston 410 (and in the present example, of piston 412) is thereby relatively damped near such one end 424 of cylinder 264.

More specifically, the fluid port means includes a combination of the end cap member 406 for receiving the cylinder ends, a central passageway generally 444 formed in end cap 406, and a fluid channel generally 446 interconnecting the exterior (for example wall 436) of the end cap 406 with the central passageway 444 thereof. In such an arrangement, the regulating means are generally received in the end cap central passageway 444, which passageway is generally aligned with the cylinder 264.

As further represented in the figures, at least a portion of the central passageway and of the regulating means are respectively threaded (see generally threads 448) so that the regulating means may removably received in the central passageway 444.

The regulating means includes a first insert generally 450 fixedly received within the central passageway 444 and a second insert generally 452 movably received within the first insert 450 and comprising the regulating means movable actuation member or movable insert 416. In such an arrangement, a cavity 454 is provided within the first insert 450 for receiving the spring or biasing means 422. An end 456 of second insert 452 opposite to end opening 428 thereof receives one end of spring 422. The opposite end of spring 422 may be retained such as by a capture member 458 mounted on end cap 406 and across such opposite end of the spring. A plurality of bolts 460 or the like (preferably 4) may be threadably received within the end cap 406, as represented in the figures. With such an arrangement, the biasing force of spring 422 is transmitted to the second insert 452 in a direction so that such insert is thrust towards cylinder 264 for resiliently assuming the first position thereof.

While different specific arrangements for the exemplary first and second inserts 450 and 452 illustrated herewith may be practiced, the following specific constructions comprise one suitable form therefor. FIGS. 24 through 26 are not intended as being drawn precisely to scale, but are intended to represent relative relationships for an exemplary embodiment.

First insert member 450 may include an annular relief generally 462. Such an arrangement permits the hydraulic oil to travel completely around the outside diameter of first insert 450, as will be understood by those of ordinary skill in the art, and enter (i.e., pass through) any one of a number of holes 464 formed through such outside diameter within annular relief 462. Preferably, there are a plurality of such holes 464 formed through the first insert 450 generally equidistantly about such relief 462. For example, six such holes 464, each having a diameter of about 0.125 inches may be drilled in the relief portion 462. It will be apparent to those of ordinary skill in the art that such diameter size at least in one sense sets the maximum amount of flow rate which may be achieved (given specific fluid pressures) with the illustrated arrangement.

The second insert 452 likewise may include an annular relief 466 formed about the outside diameter thereof and defined adjacent the second fluid flow path hole(s) 420 thereof. With such an arrangement, hydraulic fluid may surround the outside diameter of second insert 452 whenever same is received in the second position therof (present FIG. 26) so that oil passes through bore 414, hole(s) 464, relief 466 and through bore 420. As discussed, the bore size 420 is relatively restricted and therefore reduces the relative flow rate. With such an arrangement, a single bore hole of approximately 0.030 inches will suffice. In comparison, the bore holes 418 may be larger, such as approximately 0.15625 inches (5/32 of an inch). Also, there is preferably a plurality of such holes 418, such as four holes spaced equidistantly about the diameter of second insert 452. Though not shown, a second hole 420 may be provided 180 degrees about the circumference of second insert 452 from the hole as illustrated. Different size bores may be practiced, including reversing operation so that bore(s) 420 are larger than bores 418 if it is desired to have a relative flow rate increase during such phase of operation.

The preferred reduced flow rate path of the second position of second insert 452 has already been discussed above. The first flow rate path is represented by FIGS. 24 and 25. Particularly in FIG. 25, fluid flows through lateral holes 430 into central passageway 426. Once inside the central passageway, the fluid flow path exits the second insert member 452 through one or more bores 418, so as to pass through first insert 450 via holes 464 thereof and its annular relief 462 on its way to passage 414 (or passage 446 of FIG. 24). Preferably, the arrangement is provided (as shown) so that some flow continues as second insert 452 switches over between its first and second positions. In some devices, it may be desired to have discrete jumps (and alternate interruptions) between flow rates, in which case the structure should be adjusted accordingly.

Without an additional annular relief in the area of bores 418, fluid flow will be confined to only the bores 418 which align in some part with openings 464. However, the various plurality of openings 464 about the circumference of the first insert 450 in fact ensure that an adequate portion of bores 418 participate in the hydraulic oil flow, regardless of the rotational orientation of freely movable second insert 452. Generally speaking, those of ordinary skill in the art will appreciate that fewer openings 464 and 418 could be utilized, if some form of keying system or equivalent were used to ensure a given rotational alignment of second insert 452. With the present embodiment, however, particular rotation alignment is not critical due to the plurality of holes and the use of 360 degrees annular reliefs.

It will be further appreciated by those of ordinary skill in the art, without detailed discussion, that various additional features may be practiced in accordance with the foregoing embodiments. For example, appropriate openings 468 (FIGS. 25 and 26) may be provided for use of a spanner wrench to alternately seat and remove threaded first insert 450 from threaded central passage 444 of end cap 406. Also, various O-rings or the like, such as rings 470 and 472 may be placed for appropriately sealing the hydraulic system, as understood by those of ordinary skill in the art. Fewer or greater numbers of O-ring seals may be utilized in various embodiments, depending on the particular construction thereof. Likewise, the precise dimensions and placements of various bores, annular reliefs, oil ports, and the like may be varied by those of ordinary skill in the art, in order to correspondingly obtain desired flow rates.

Still further, it will be appreciated by those of ordinary skill in the art that more than two flow rates may be established by providing a movable insert with an even longer travel path or equivalent, so that three or more sets of distinctive bores defining respective flow paths are provided for successive presentation to hydraulic oil port 414. All such variations are intended to come within the spirit and scope of the present invention.

It should be further understood by those of ordinary skill in the art that the foregoing presently preferred embodiments are exemplary only, and that the attendant description thereof is likewise by way of words of example rather than words of limitation, and their use do not preclude inclusion of such modifications, variations, and/or additions to the present invention as would be readily apparent to one of ordinary skill in the art, the scope of the present invention being set forth in the appended claims.

What is claimed is:

1. A piston responsive variable valving system for operation with a fluid activated piston movably received within a cylinder, said system comprising:

fluid port means associated with one end of a cylinder for conducting fluid in alternate directions in the cylinder for driven movement of the piston therein;

fluid flow rate regulating means received within said fluid port means for establishing one of at least two different fluid flow rates for fluid conducted therethrough so as to drive the piston, under a given load condition, at two different corresponding speeds within the cylinder, said regulating means including a movable actuation member, movement of which between respective first and second positions thereof respectively and correspondingly selects said different fluid flow rates; and biasing means, for biasing said movable actuation member into said first position thereof protruding into the cylinder and in the travel path of the piston movably received therein so as to select a corresponding first fluid flow rate through operation of said regulating means, and for permitting said movable actuation member to be moved into said second position thereof responsive to engagement with the piston so as to select a corresponding second fluid flow rate through operation of said regulating means; and wherein said valving system comprises part of drive means for a lifting apparatus comprising a hydraulically actuated lifter mounted on a relatively larger front end load container box adapted to be carried on a refuse collection vehicle for subsequent emptying of the container box contents into a refuse receiving part of the vehicle.

2. A variable valving system as in claim 1, wherein said movable actuation member projects into the cylinder a relatively small distance in said first position thereof so that piston engagement occurs as such piston nears such one end of the cylinder.

3. A variable valving system as in claim 1, wherein:

said fluid port means includes an end cap member for receiving the one end of the cylinder, a central passageway formed in said end cap, and a fluid channel interconnecting the exterior of said end cap with said central passageway thereof; and further wherein said regulating means is received in said end cap central passageway.

4. A variable valving system as in claim 3, wherein said regulating means includes a first insert fixedly received within said central passageway and a second insert movably received within said first insert and comprising said regulating means movable actuation member.

5. A variable valving system as in claim 4, wherein the cylinder and piston comprise part of said drive means for a refuse collection cart lifting apparatus, and wherein said second fluid flow rate is less than said first fluid flow rate so as to dampen strain forces on the lifting apparatus and the associated collection cart just as the cart is fully raised and inverted for dumping the contents thereof.

6. A variable valving system as in claim 2, wherein said relatively small distance comprises no more than one-third of the length of said movable actuation member.

7. A variable valving system as in claim 6, wherein said relatively small distance comprises no more than about 20% of the length of said movable actuation member.

8. A variable valving system as in claim 7, wherein said relatively small distance comprises no more than about 10% of the length of said movable actuation member.

9. A refuse collection vehicle comprising a container box at the front of the vehicle, a lifting apparatus, mounted on said container box, for lifting and tipping residential refuse collection carts into said container box, and means for lifting and tipping said container box into a refuse receiving part of the vehicle.

10. A combination front end load container box and lifter, for use with a refuse collection truck, said combination comprising:

a relatively larger refuse container box having truck engagement means for selectively securing said box to a refuse collection truck so as to be carried thereby and so that the contents of said box may be periodically raised and dumped into a generally upper opening refuse hopper of such truck; and a cart lifter mounted on said container box for being carried therewith by a refuse collection truck, said cart lifter comprising means for selectively raising and dumping the contents of a residential refuse collection cart into said container box;

wherein said combination front end load container box and cart lifter may be alternately engaged and disengaged with a refuse collection truck for selected use therewith.

11. A combination front end load container box and lifter as in claim 10, wherein said cart lifter includes means for automatically engaging and lifting a residential refuse collection cart to be emptied.

12. A combination front end load container box and lifter as in claim 10, wherein said cart lifter includes means for alternatively automatically engaging and lifting different styles of residential refuse collection carts having different numbers of lift pick up points.

13. A combination front end load container box and lifter as in claim 11, further including vertical adjustment means for relatively vertically shifting operation of said cart lifter so as to engage a residential refuse collection cart to be dumped at a variable raised engaging position.

14. A combination front end load container box and lifter as in claim 10, wherein said cart lifter further includes drive dampening means for selectively slowing operation of said cart lifter as a residential refuse collection cart raised thereby is dumped, to dampen strain on said cart lifter and the residential refuse collection cart being dumped during final dumping thereof.

15. A combination front load container box and lifter as in claim 10, wherein said cart lifter further includes cart engagement means comprising a movable clamp bar for clamping onto said lifter a refuse collection cart of the type having a single upper lip to be clamped during lifting of such cart.

16. A combination front load container box and lifter as in claim 10, wherein said cart lifter further includes cart latching means for latching onto said lifter a refuse collection cart of the type having a pair of opposing latch engagement surfaces.

17. A combination front end load container box and lifter as in claim 16, wherein said cart latching means are movably mounted on said cart lifter so as to automatically be pivoted into an inoperative position thereof during lifting of a refuse collection cart of the type having a single upper lip to be clamped during lifting of such cart type, and wherein said cart lifter further includes a movable clamp bar for clamping onto said lifter a refuse collection cart of the type having a single upper lip to be clamped during lifting of such cart type, whenever said cart latching means are movable deflected from such cart type during lifting thereof.

18. A combination front end load container box and lifter as in claim 10, wherein said container box has a substantially open top, and said container box holds generally in a range of from about 1 to about 3 cubic yards of refuse.

19. A combination front end load container box and lifter as in claim 10, wherein said container box includes a recessed lifter mounting area on one lateral side thereof, and wherein said cart lifter is mounted within said recessed lifter mounting area.

20. A combination front end load container box and lifter as in claim 19, further including a kick plate adapted to be mounted on the refuse collection truck in a position so as to engage and guide said cart lifter as the contents of said container box are raised and dumped by such refuse collection truck, so that said cart lifter does not interfere with any parts of the refuse collection truck.

21. A combination front end load container box and lifter as in claim 10, wherein said truck engagement means includes a pair of fork channels situated on respective sides of said container box for being selectively engaged by a corresponding pair of lifting forks mounted on the front of a refuse collection truck to be used with said combination.

22. A combination front end load container box and lifter as in claim 21, wherein said truck engagement means further includes internal angled plates received within said respective fork channels for relatively tightening the fit of truck lifting forks received therein, and further includes removable pins for securing the position of the truck lifting fork tips received by said truck engagement means fork channels.

23. A combination front end load container box and lifter as in claim 10, wherein said cart lifter comprises a hydraulically actuated cart lifter.

24. A combination front end load container box and lifter as in claim 23, further including a hydraulic drive circuit and control circuits therefor mounted on said container box with quick-disconnect style connectors comprising a hydraulic power coupler to be selectively operatively associated with a corresponding hydraulic power coupler carried on a refuse collection truck with which said combination container box and lifter are to be used.

25. A combination front end load container box and lifter as in claim 23, wherein said hydraulically actuated cart lifter includes hydraulically actuated rotary drive means.

26. A combination front end load container box and lifter as in claim 25, wherein said rotary drive means comprises a hydraulically actuated rotary motor with an output shaft thereof positioned substantially perpendicular to the plane of movement of a refuse collection cart to be dumped, said rotary motor including rack and pinion gear teeth respectively supported on a reciprocating piston rod and on a rotatable portion of said output shaft passing through said rotary motor, and further wherein said rack and pinion teeth engage one another emersed in hydraulic fluid within a cylinder of said rotary motor for lubrication thereof.

27. A combination front end load container box and lifter as in claim 23, further including hydraulic fluid flow rate regulating means associated with said cart lifter for controllably establishing at least two different fluid flow rates for establishing two different corresponding operational speeds of said hydraulically actuated cart lifter.

* * * * *